US006845589B1

(12) United States Patent
Thompson et al.

(10) Patent No.: US 6,845,589 B1
(45) Date of Patent: Jan. 25, 2005

(54) CABLE GATE

(75) Inventors: Ian Reginald Thompson, Duncraig (AU); Ralph Tony Sarich, Perth (AU)

(73) Assignee: Matilda Products Ltd., Perth (AU)

( * ) Notice: Subject to any disclaimer, the term of this patent is extended or adjusted under 35 U.S.C. 154(b) by 0 days.

(21) Appl. No.: 09/806,573

(22) PCT Filed: Oct. 1, 1999

(86) PCT No.: PCT/AU99/00846

§ 371 (c)(1),
(2), (4) Date: May 14, 2001

(87) PCT Pub. No.: WO00/20692

PCT Pub. Date: Apr. 13, 2000

(30) Foreign Application Priority Data

Oct. 1, 1998 (AU) ..... PP6306
Jul. 2, 1999 (AU) ..... PQ1385

(51) Int. Cl.[7] ..... E01F 13/00
(52) U.S. Cl. ..... 49/49; 49/34
(58) Field of Search ..... 49/34, 49, 131; 160/330, 331, 332

(56) References Cited

U.S. PATENT DOCUMENTS 4,844,653 A * 7/1989 Dickinson ..... 404/6
5,245,787 A * 9/1993 Swenson et al. ..... 49/34
5,452,542 A * 9/1995 Bardwell ..... 49/34
5,537,778 A * 7/1996 Bardwell et al. ..... 49/34
5,752,559 A 5/1998 Minow ..... 160/328
6,135,190 A * 10/2000 Gompertz et al. ..... 49/34
6,192,627 B1 * 2/2001 Gompertz et al. ..... 49/34
6,349,503 B1 * 2/2002 Gompertz et al. ..... 49/34
6,485,225 B1 * 11/2002 Baker ..... 49/34

FOREIGN PATENT DOCUMENTS

EP 0 269 473 6/1988
EP 0 678 626 10/1995

* cited by examiner

*Primary Examiner*—Jerry Redman
(74) *Attorney, Agent, or Firm*—Baker & Daniels

(57) ABSTRACT

A gate for controlling passage through an opening including a first support located on one side of the opening, a second support located on the other side of the opening, at least one elongate member, having a first and a second end, extendable across the opening between the first and second support; and a control for releasing the at least one elongate member to whereby enable passage through the opening and drawing in the elongate member to thereby restrict passage through the opening.

66 Claims, 14 Drawing Sheets

CABLE GATE

FIELD OF THE INVENTION

The present invention relates to an improved gate, and in particular to cable or chain security gates, and may for example be used to replace existing boom and security gates.

BACKGROUND OF THE INVENTION

Conventional gates are used either to prevent unauthorised access to a site (security), or for access control purposes.

Security gates prevent vehicular access and are constructed in a variety of formats. Typical examples incorporate sliding, swinging, or vertically raising (or lowering) panels, and are constructed of steel tube, wood, steel mesh, plastic, other materials, or combinations of these materials. The gates may be manually opened, or may utilise one of a number of alternative hydraulic, electrical, electro-hydraulic, or other actuation mechanisms. Automatic control devices may also be provided, to allow for remote (wireless) or security system opening of the gate. As well as preventing unauthorised access, these gates also provide access control.

Another form of access control gate is the boom gate, constructed typically of a long wooden, aluminium or steel beam pivoted about a horizontal axis at one end. Applications include access control into public car parks, and as warning devices at railway level crossings. Boom gates are used more for access control, than security purposes, as it is not very practical to construct them strong enough to prevent deliberate unauthorised access. These gates may also be automatically, manually, or remotely opened and closed.

A number of functional weaknesses may be noted for most conventional gates, particularly automatic gates.

Most automatic gates are quite expensive to purchase and operate, as the gate panels are heavily and expensively constructed, their actuation mechanisms are large and costly, mechanical and electrical or hydraulic services must be installed and connected between the gate and a suitable source, and considerable work is needed to provide the foundations for the necessarily precise gate mechanisms.

Existing gates are also not very space efficient. For example, a swinging gate must have room for the gate panels to swing into, and the panel of a sliding gate requires at least the full opening width again, behind an associated fence. Similarly, poles that are raised telescopically from a hole in the ground require substantial below-ground excavation, and are prone to jamming due to the ingress of sand and water.

Further, many gates are not constructed strong enough to withstand deliberate attempts at unauthorised access, and most automated gates are relatively slow to open (for safety reasons).

Conventional swinging, sliding, or raising gates also tend to be quite slow to open and close, particularly if they are built heavy and strong to withstand deliberate attempts at unauthorised access. The reasons are twofold. Firstly, the inertia of these types of gates is large, requiring high accelerating forces to achieve reasonable speed of operation. This would require large and expensive actuation mechanisms, making the whole approach commercially unattractive. The second, and more important reason, is that heavy gates travelling at high speed (and using high forces) would present a serious hazard to personnel, animals, and equipment such as vehicles. This is because, due to the extremely high inertia levels that would be involved, their overload protection and other safety devices would be rendered ineffective. This is particularly the case if the gates are automatic, and therefore may be operated unintentional, or unexpectedly.

Slow opening times can be particularly annoying to the user, who may need to make regular authorised accesses to a secure site. For example, this may include a home owner entering his own property, or someone wishing to legitimately enter a private parking area. Generally, it is usually not so important for the gate to close quickly.

A further problem with existing gates is their operation when their power source is removed, either through a power failure or illegal means. In many cases, the gate is configured to automatically open in the event of a power failure, for example the gate is no longer held closed, as a spring acts to open the gate. Obviously, security is compromised in such situations.

OBJECT OF THE INVENTION

It is an object of the present invention to provide a gate which addresses at least one of the weaknesses of conventional gates identified above. In particular it is an object of the present invention to provide an improved gate that is low in power consumption, space efficient, fast to open, in-expensive to manufacture and install, intrinsically safe, and ideally automatic and more effective in restricting deliberate attempts at unauthorised vehicular access.

SUMMARY OF THE INVENTION

With the above object in mind the present invention provides in one aspect:

a gate for controlling passage through an opening including:

a first support means located on one side of the opening;

a second support means located on the other side of the opening;

at least one elongate member, having a first and a second end, extendable across the opening between said first and second support means;

a first drive means to draw in said elongate member to thereby restrict passage through said opening; and a control means for coupling and decoupling said first drive means; wherein decoupling of said first drive means allows for release of said at least one elongate member to thereby enable passage through said opening, and coupling of said first drive means allows for drawing in said elongate member to thereby restrict passage through said opening.

In the preferred embodiment the elongate member could be a cable, or alternatively a chain, rope, cord, rod or pipe provided with flexible end fittings, or similar arrangement.

In a further preferred embodiment, the first and second support means could be posts. Alternatively, walls, or many other forms of architectural structures (for example columns, arch supports, beams, light poles, or even statues), could form the support means. For simplicity further reference will only be made to posts, although it will be understood that this reference also refers to all other structures.

Preferably, the control means would be located substantially wholly within one of said first or second support means, to limit access to said control means.

The gate could further include a locking means to prevent unwanted release of the at least one elongate member once the at least one elongate member has been fully drawn in. Conveniently the locking means could include a latching means adapted to engage a termination means attached to the at least one elongate member.

The termination means could be a thimble, hook, eye, T-bar, or devise assembly. It will be understood that the termination means may include a part of the at least one elongate member. For example, in a thimble assembly the end of the elongate member is wrapped around a thimble and swaged back to itself. In this circumstance the portion of the elongate member forming the thimble assembly should be considered as part of the termination means and not the elongate member.

Preferably the gate further includes a first line connecting said first end of said at least one elongate member to a first drive means such that said first drive means operates to draw in said first line thereby drawing in said at least one elongate member. Ideally, the first line is thin and lightweight, for example it could be a steel or synthetic cable or strap. Further, the first line could be attached to said termination means.

The second support means may further include a traction means to draw said at least one elongate member towards said second support means during release of the at least one elongate member. Further, said first support means may also include a tracking means. The traction means may include an aperture in said second support means through which a first counterweight line may pass. One end of said counterweight line being attached to said at least one elongate member, and the other end attached to a first counterweight.

Ideally the aperture would be located a predetermined distance below said at least one elongate member and substantially equal to the distance between said second support means and a point where said first counterweight line is attached to said at least one elongate member.

A further improvement to enable retraction of the said at least one elongate member along a side of said second support means would include a bar running along an end portion of said at least one elongate member, and adjacent to said second support member.

Where a plurality of elongate members are provided, it may be preferable to provide a bar, running along an end portion of each, or a selection of, the elongate members, to further improve retraction.

Alternatively, said at least one elongate member is connected to a bar pivotally attached to said second support means.

Alternatively, a resilient means could be utilised in place of said traction means.

The first drive means may include a winch means including:

a winch drum fixed to a drive shaft.

Preferably, however, the first drive means may include a winch means including:

a winch drum adapted to freely rotate on a drive shaft;

a drive collar rotatable with, and slidable along, said drive shaft;

an engaging means adapted to enable said drive collar to engage and disengage said winch drum.

Ideally, a braking means is provided to limit the speed of the winch drum when not engaged with said drive collar.

In a further preferred aspect the present invention provides a tracking means to track said first line along said winch drum including:

a fixed pulley;

a second pulley mounted on an arm, said arm being spring loaded and capable of swinging;

wherein said first line tracks around said fixed pulley and then said second pulley prior to being wound on said winch drum.

In a further aspect the present invention provides a gate for controlling passage through an opening including a first support means located on one side of the opening; a second support means located on the other side of the opening; at least one elongate member, having a first and a second end, extendable across the opening between said first and second support means, wherein said first and/or second end is joined to a termination means adapted to engage a locking means located in said first or second support means; and a control means for releasing said at least one elongate member to thereby enable passage through said opening, and drawing said elongate member towards a first aperture in said first or second support means; wherein said elongate member remains substantially external to said first or second support means when said gate is in a locked or closed position.

Again it is to be understood that the component parts of the termination means is not to be considered as part of the elongate member. That is, any portion of the elongate member which is used to form the termination means then becomes a component part of the termination means and not the elongate member.

In another preferred aspect the present invention provides an improved latch mechanism including:

a latch or locking pin adapted to be released by a release lever;

a first and a second spring each fixed at one end;

a belt passing around a pulley means and connecting said first spring to said second spring; and a release line attached to said release lever and said belt.

Conveniently, the release line may pass through the centre of the first spring, or alternatively in some arrangements the release line may pass outside of the spring.

In the preferred embodiment of the present invention the latch mechanism would be driven by said winch means. Alternatively, the latch mechanism may be controlled by said first drive means. Further, the release lever would also include a return spring adapted to return the release lever to a locked position.

In a further aspect the present invention provides a latch mechanism including:

a latch or locking pin adapted to be released by a release lever;

a member attached via a ratchet means to a winch means; and a release line joining said release lever to said member.

In a preferred aspect the present invention provides an improved latch mechanism including:

an assembly adapted to slide along and rotate with a drive shaft; said assembly including a pulley and clutch dog;

a plurality of cams, including a first and second cam;

a plurality of reaction plates, including a first and second reaction plate; wherein said first cam is adapted to engage said first reaction plate, to thereby engage said clutch dog with a winch means; and said second cam is adapted to engage said second reation plate, to thereby disengage said clutch dog from said winch means.

In a further aspect the present invention provides a battery located wholly within said first or second support means to provide the power to operate the gate. Preferably, an external power source will be connected to the battery to enable the battery to be recharged. In this arrangement one external power source, by mains or solar, need not have sufficient power to operate the gate, but rather need only be capable of recharging the battery over time.

In some applications it may be desired to provide a series of gates as defined by the present invention. In such an arrangement a predefined distance may be left between adjacent gates, or alternatively two adjacent gates may have a common support means.

BRIEF DESCRIPTION OF THE DRAWINGS

The present invention will be further described with reference to the accompanying drawings. It will be appreciated by the person skilled in the art that other embodiments of the present invention are possible, and therefore the particularity of the accompanying drawings is not to be understood as superseding the generality of the preceding description of the invention.

DETAILED DESCRIPTION OF DRAWINGS

Figure 1:
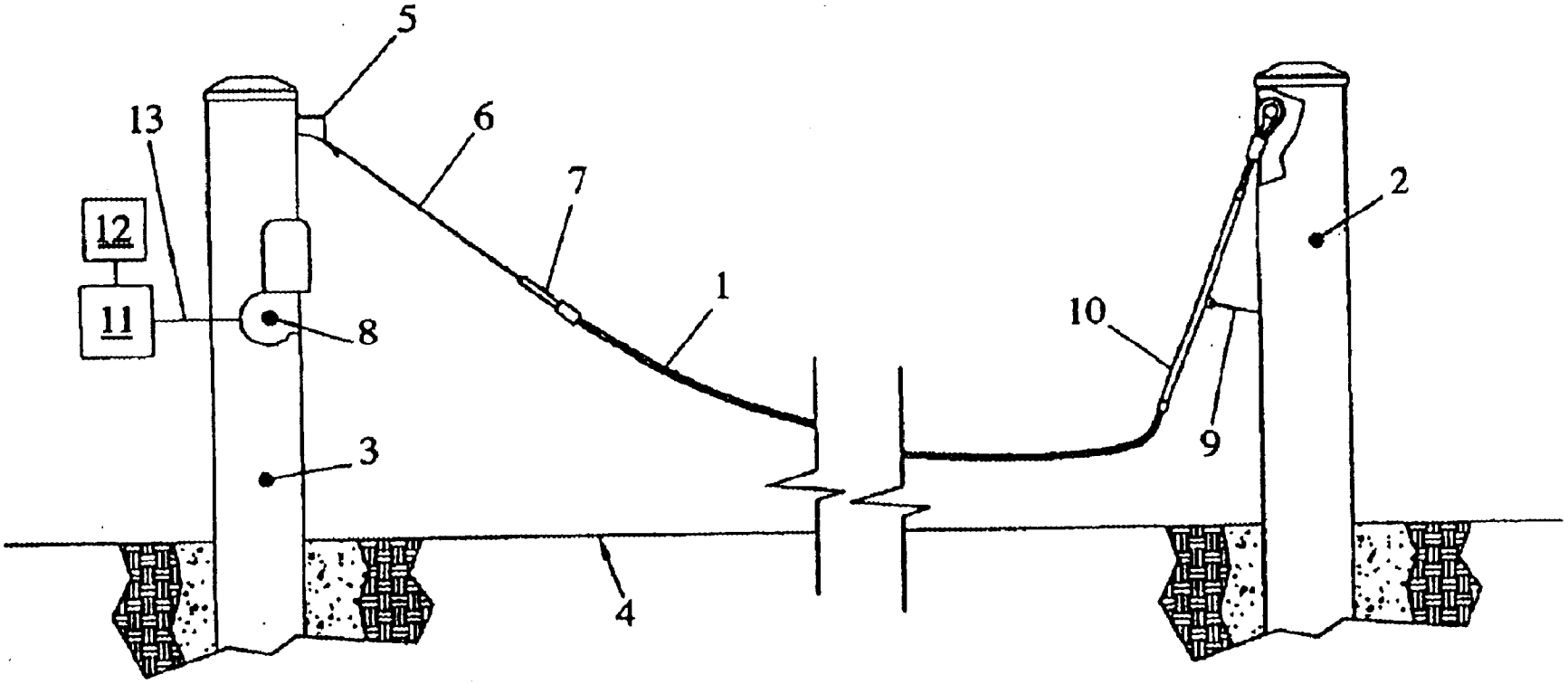
FIG. 1 shows the overall configuration of the improved gate in a partially closed configuration.

Referring now to FIG. 1, the present applicants have found it feasible to construct a security gate using steel cable (1) or chain stretched between two anchor posts (2, 3). By making the cable (1) or chain permanently anchored at a second post (2), and capable of being fed out from, or drawn into a first post (3), it is possible to effectively open and close the gate to vehicular traffic. Alternatively, the cable (1) or chain could also be fed out from, and drawn into the second post (2) as well as the first post (3), if required. In the open position, the cable (1) or chain would be arranged to lie on the road (4) or ground surface, or in a suitable groove, for vehicles to drive over. When closed, the cable (1) or chain would form a barrier between the two posts(2, 3), preventing access.

If high strength steel cable or chain had been previously considered for the gate of the present invention then conventional teaching of a means for reeling the cable or chain into the post would have resulted in a necessarily large, heavy, expensive, and bulky apparatus. This is because the winch drum must be of sufficiently large diameter to accept the heavy cable or chain, and must be sufficiently strong to support the maximum tension loads if an attempt is made to breach the gate. For steel cable, the winch drum must also be sufficiently large to prevent the cable from going below a minimum bend radius, thereby compromising the cable's fatigue life, or from being irreversibly distorted which will render it unusable in that it would not lie flat on the road.

Figure 2A:
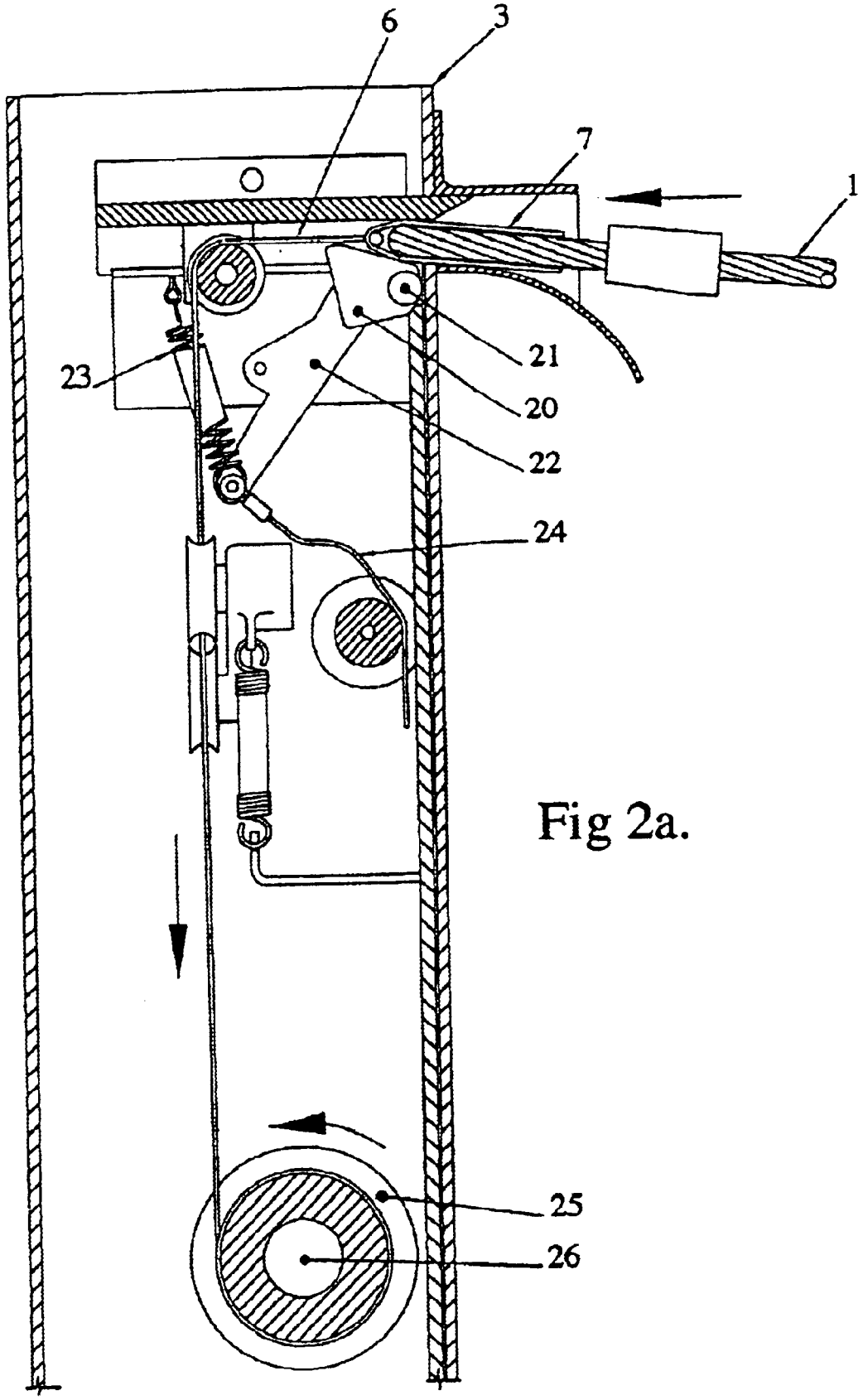
FIG. 2*a* shows the locking action of the latch mechanism

Therefore, in the present invention, a high strength cable (1), preferably steel, may be anchored to a passive post (2) located to one side of an opening or roadway (4), and the other end of the main cable (1) can be drawn into a master post (3) located on the other side of the roadway (4), by means of a thin lightweight "pull-in" cable (6). This second end of the main cable is fitted with a termination means such as a thimble assembly (7) (or similar), which can be locked into place in the master post (3) by a latching mechanism once the gate is fully closed. FIG. 2*a* shows the thimble (7) being drawn over the latch (20), by the action of the winch (25) and pull-in cable (6) preparatory to the gate locking. It can be seen that as the thimble (7) is drawn past the latch (20) the latch return spring (23) is stretched. Once the thimble (7) has passed the latch (20) the return spring (23) causes the lever arm (22) to return the latch (20) to its locked position thereby locking the gate, as can be seen in FIG. 2*b*.

It will be appreciated that the termination means need not be a thimble assembly, but may be any means suitable to allow the main cable to be locked in place. For example, the termination means could equally be a hook, eye, T-bar or devises.

Figure 2B:
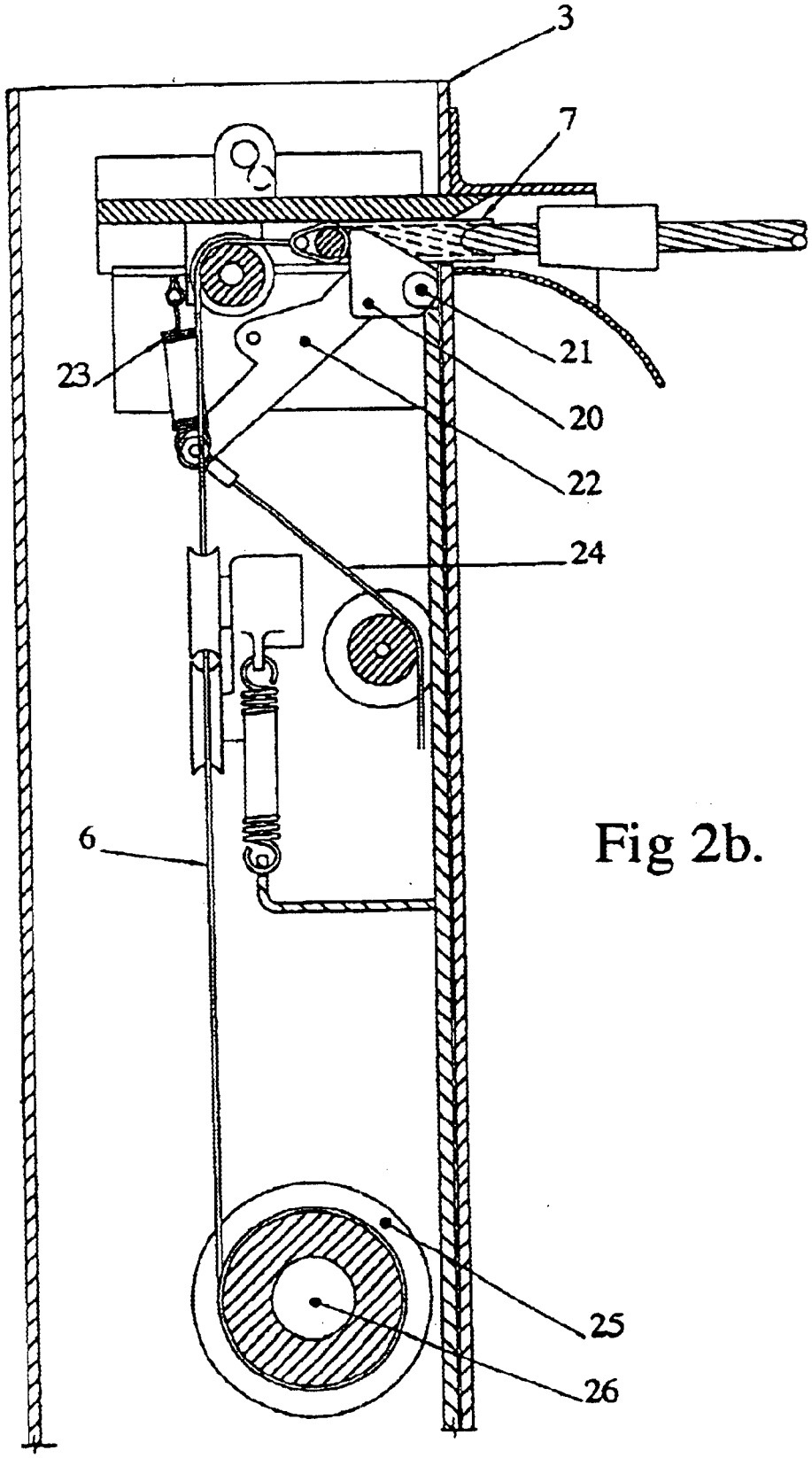
FIG. 2*b* shows the locked position of the gate.

As can be seen from FIG. 2*b* the incorporation of the termination means (7) has the advantage that the main cable (1) need not enter the master post (3), rather only the termination means (7) needs to enter the master post (3). Accordingly, the components and space required for the master post (3) can be less expensive, smaller and cheaper to run.

In the preferred embodiment a 10 mm diameter stainless steel wire rope forms the main cable (1), as this provides a suitably high level of strength, is corrosion resistant, is relatively difficult to cut, and does not cause undue damage to the road (4), or impede the passage of normal vehicles over it. Depending on the application and strength requirements of the cable, larger or smaller diameter cable can be selected, or even synthetic cord or rope can be utilised.

It has been found that an 8 tonne force would be required to pull out a 10 mm steel cable from the master post (3) of the present invention. Accordingly, the selection of the post material and/or modifications of the post (2, 3) may be necessary dependent on the cable (1) selected for the particular application, so as to ensure the gate works effectively, and that the post (2, 3) is not unduly weak.

The pull-in cable (6) strength, and therefore diameter, should be selected to suit the main cable span, and diameter or weight of the main cable (1). Tests have shown a 1.6 mm diameter cable to be suitable for use with a 10 mm diameter main cable over realistic spans, providing both satisfactory performance and fatigue life. Ideally, the pull-in cable (6) is also a stainless steel wire rope for its corrosion resistance, and should be of a flexible weave to enable the cable (6) to lay neatly on the winch drum (25) and pass easily over the pulleys.

Once it is in place and locked, then the main cable (1) is unable to be withdrawn from the master post (3) even at high force levels, unless the latch (20) is first unlocked. This is ideally performed by an internal mechanism, that is, a mechanism that is not readily accessible from the outside of the gate. The latching function may take the form of a latch (20) attached to a latch pivot shaft (21). This form of latch is, in a sense, self-energising, in that any attempt to withdraw the main cable (1) only acts to more strongly hold the latch

(20) closed. It is necessary for the latch (20) to be rotated against the cable load, in order for the cable thimble (7) to be released. A lever arm (22) attached to the latch pivot shaft (21) may be utilised to perform this unlocking function. Alternatively, a retracting bolt or other form of latch could be utilised.

The internal mechanism required to release the latch might take the form of an electrical solenoid, which could for example pull back a bolt, an electric motor drive, a manually operated key assembly, or other similar means.

The present invention could be operated by a simple control system (11) used to control operation of the electric motor (8), and of the unlocking mechanism. Additionally, micro-switches may be used to detect both the locked and unlocked status of the gate.

The pull-in cable (6) is not exposed to the security loads needed to be withstood by the main cable (1), and therefore need only be strong enough to draw, or pull-in, the main cable (1) to the master post (3) latch mechanism (20), and may therefore be constructed using quite small diameter wire rope, or even synthetic material such as a nylon rope. The pull-in cable winch drum (25) may similarly be constructed to be physically small, of low cost, and light-weight. In the preferred embodiment, the winch drum (25) and winch shaft (26) are made of inexpensive plastic materials, and are small enough to be fitted within the master post (3). Similarly, the winch drive mechanism may also be constructed using small, light-weight, and inexpensive componentry. In the preferred embodiment, this drive mechanism makes use of a very low-cost electric motor and drive assembly, such as normally might be used for high volume automotive application, for example driving windscreen wipers or window winders. In preferred embodiments it may be feasible to mount a smaller drive motor inside the existing post, or to fit the prototype motor within a slightly larger post.

Manual methods may also be used to activate the winch mechanism. For example, a crank handle and ratchet mechanism could be used in place of the electric motor, or a single stroke foot driven treadle device, or even a pull rope wrapped on a spring returned drum could be utilised. Or, a simple rope could act directly as a pull-in cable, for a manually closed system.

The use of the pull-in cable (6) in conjunction with the main cable (1) provides a gate that is of low cost, is strong, and is considerably more space efficient than conventional gate formats. The small drive mechanism also has very low power consumption characteristics, making it attractive for applications that are power sensitive, and may therefore be battery or solar driven and not just mains driven.

Inclusion of a rechargeable operating battery as part of the operating mechanism located inside the master post provides a number of benefits. Firstly, a power fail-safe feature is provided. Typically, the internal battery may be used to operate the gate 400 times, even when external power is lost, before recharge is required. Secondly, the use of a low voltage drive system provides increased safety for installers, operators and maintenance personnel. The installation costs are also reduced, as only low-voltage wiring needs to be run to the post to enable the battery to be recharged. A further advantage is that the battery is now located close to the motor, so losses are reduced, and heavy wiring to the post is no longer required.

Conveniently, the battery's level of charge may be maintained through the use of a low-voltage plug-pack (12) located well away (e.g. 100 meters) from the gate, and connected by safe, low-voltage, low-current wiring. Alternatively, a small solar panel which would otherwise be unable to supply enough current to the motor, may be used to maintain the battery's state of charge.

That is, the gate is substantially immune to power failure, as the internal battery powers the gate. An external power source can be used to recharge the battery. In this regard the external power source would not be able to provide sufficient power to operate the gate, but is able to recharge the battery over time. This arrangement also improves the security of the gate, as illegal access cannot be gained simply by cutting the power source to the gate.

Location of the motor (8), external to the master post, and driving the internal mechanism through a small access hole, allows for simple upgrade to a higher power motor, should this be required for particular applications. For example, a larger motor could be used to achieve faster closing times, or to lift heavier cables over longer spans, without change to the internal mechanism.

Due to the low pull-in loads involved, this gate allows the use of lightweight and low cost plastic parts for construction of its operating mechanism. However, most plastic parts are known to "creep" or deform, in the presence of even moderate loads when applied at high temperature. Also, it is desirable for tension on the pull-in cable to be released once the gate is locked, so that movement of the main cable will not act to cause metal fatigue in the pull-in cable. Accordingly, a method has been devised to de-tension the operating mechanism once the gate is locked. This is achieved by very briefly reversing the drive once a locked condition has been detected, without driving so far as to release the gate. This unloads the pull-in cable and overload (tracking) spring, and may even allow the clutch to disengage. The main cable load is then taken fully by the latch pin. Some "dead-band" may be easily designed into the operating mechanism to assist this process.

In a preferred embodiment, the winch drive that draws in the pull-in cable (6) may also be used to activate a latch release lever (22) attached to the latch pivot shaft (21) (when driven in the release direction). In this improved release mechanism, the release cable (24) is activated from the pull-in cable winch drum shaft (26), using the principles of a capstan drive. In one embodiment a V-belt system can be used to keep the drive physically small. As can be seen from reference to FIG. 3*a*, when the winch shaft (26) is rotating to draw in the pull-in cable (6) to close the gate, then due to friction on the belt (30), spring A (32) will continue to stretch until the force in spring B (33) approaches zero. By this means the release cable (24) is detensioned, allowing the pivoting latch (20) to be returned to its locked position by means of a return spring (23). Thereafter, the winch (25) may continue to reel in the pull-in cable (6), without spring A (32) being further stretched. This is because the V-belt (30) is now able to slip on its pulley (31).

Figure 3A:
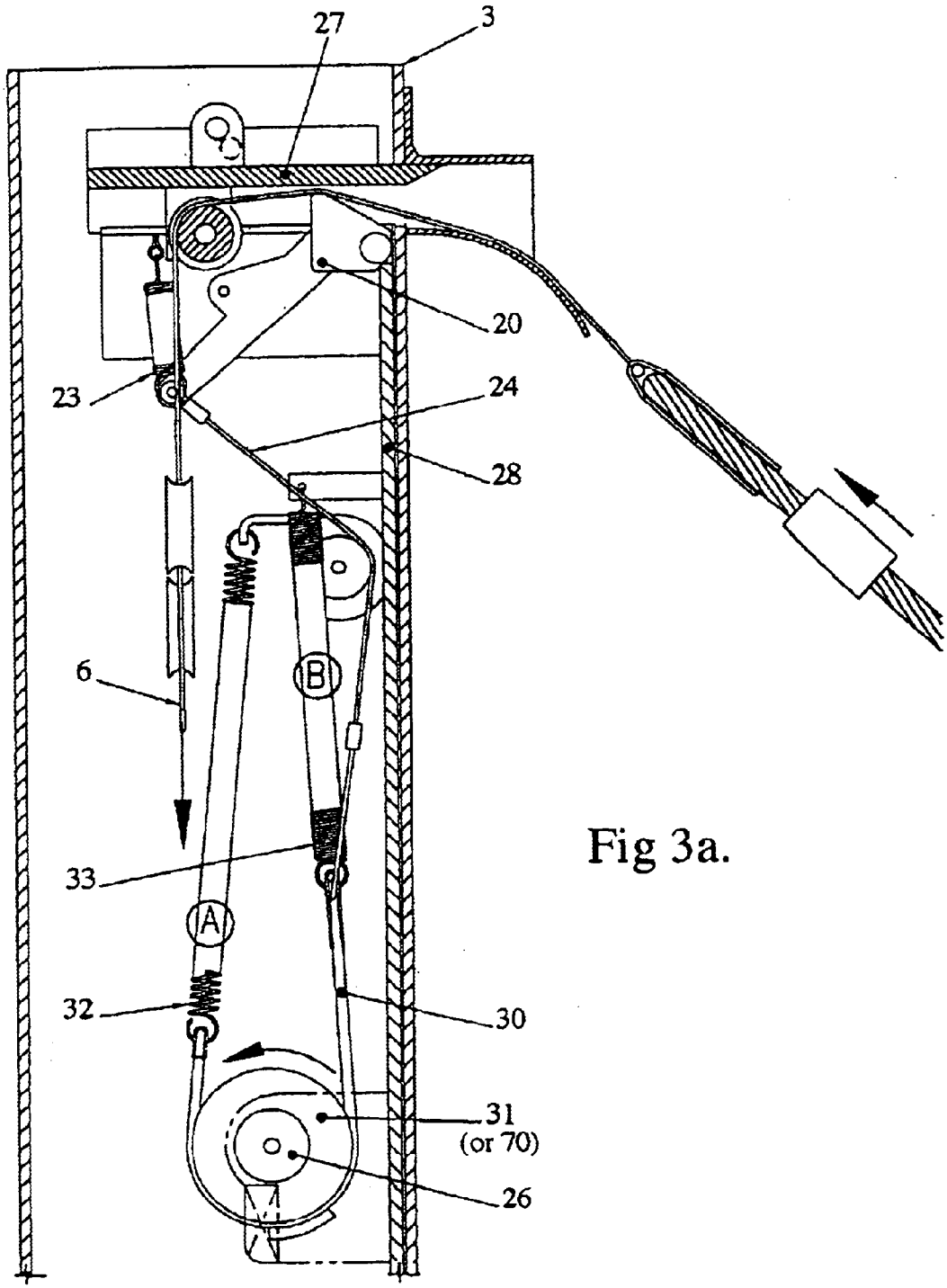
FIG. 3*a* shows the spring arrangement during locking.
Figure 3B:
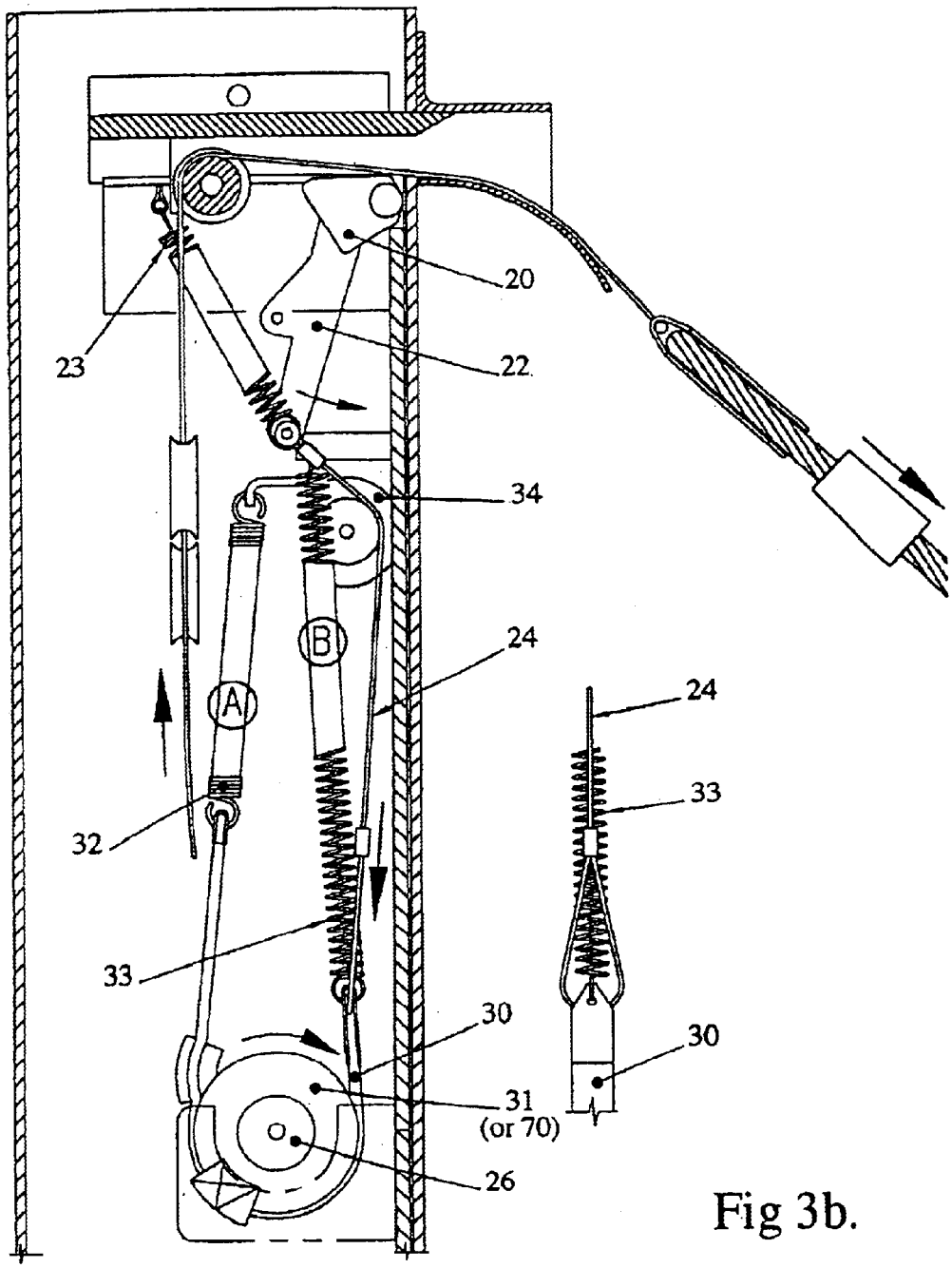
FIG. 3*b* shows the spring arrangement during the process at unlocking and cable release.

Similarly, when the gate is required to be opened the electric motor and winch shaft (26) (carrying the V-belt pulley), are arranged to rotate in the reverse direction (refer FIG. 3*b*). This causes spring B (33) to be stretched, carrying with it the release cable (24), which then acts on the pivoting latch release lever (22). This action continues until the latch (22) is able to unlock the main cable end, and until the force in spring A (32) approaches zero. Note that until spring A (32) is de-tensioned, the force that the V-belt (30) may apply to the release cable (24) is extremely high. This is because the tension in the belt (30) will increase exponentially around the pulley (31) (as per the action of a capstan drive).

The length of spring A (32) and the release cable (24) is adjusted to ensure that the latch (22) will fully disengage. Thereafter, the winch (25) is able to continue to reel out the pull-in cable (6) (allowing the main cable (1) to drop, thereby opening the gate), without further stretching of spring B (33).

FIG. 3*a* shows how the spring A (32) is stretched under the action of V-belt (30) and pulley (31), as main cable (1) and thimble (7) are being pulled in. Spring B (33) has reached its solid height, and the belt (30) is slipping on the pulley (31) to allow the closing process to continue. FIG. 3*b* shows how the gate is opened when the drive direction is reversed. In this case the spring B (33), is stretched, and the belt (30) acts on the release cable (24) to pull the latch (20) open against its return spring (23). The main cable (1) is released.

The release cable (24) must be strong enough to retract the latch release lever (22), and ideally flexible enough to pass over a pulley. A 1.6 mm diameter stainless steel wire rope has been found suitable for this function. Conveniently, the release cable (6) attached to the release lever (22), passes around a pulley, and through the centre of spring B (33), and is attached to one end of the belt (30). Alternatively, in some arrangements it may be preferable to lengthen spring B (33) such that it is not practical to have a spring B (33) and the release cable (24) anchored at the same, or a similar, position. In these circumstances, the spring B (33) may be angled such that it is anchored at a different location, while still performing the same function. In these circumstances, it is more convenient for the release cable (24) to pass outside of the spring as shown in FIG. 3*b*.

The present invention therefore also provides a means of releasing the latch mechanism (20) using a few small, simple, and inexpensive components, while at the same time providing a very high release force capability and may derive its power from the existing winch drive electric motor (or other) drive mechanism.

As an alternative to the latch mechanism disclosed above, the pulley, belt and spring arrangement could be replaced with a spool or arm attached to the main drive shaft by means of a ratchet arrangement. The release cable or line would attach to this spool or arm. When operating in the pull-in direction, the ratchet would allow the spool or arm to remain stationary as the shaft turns to draw in the first line. However, when the motion of the shaft is reversed, the ratchet would act to force the spool or arm to rotate with the shaft, thereby winding in and pulling the release line.

Ideally, It is necessary to detect both that the latching pin is in the locked position, and that the cable end (eg. thimble) is correctly in position, to be assured that the gate is fully and correctly locked. It is insufficient to only detect the position of a thimble, as this could occur without the latching pin being in place. Similarly, in the preferred embodiment the latching pin is raised prior to entry of the cable end, and therefore does not indicate a "locked-gate" condition.

It would be possible to utilise separate micro-switches to detect both that the cable end is in place, and that the latching pin is raised. However, this would require additional switch mounting and wiring etc., which is not preferred due to the additional space, wiring, and costs involved. An alternative is to mount a single limit switch onto the pivoting latch pin assembly, arranged to detect the presence of the cable end only when the latch is in the raised position. This method is also not preferred, as the limit switch is exposed to high vibration loads, and its wiring is subject to fatigue failure due to multiple bending.

Figure 9:
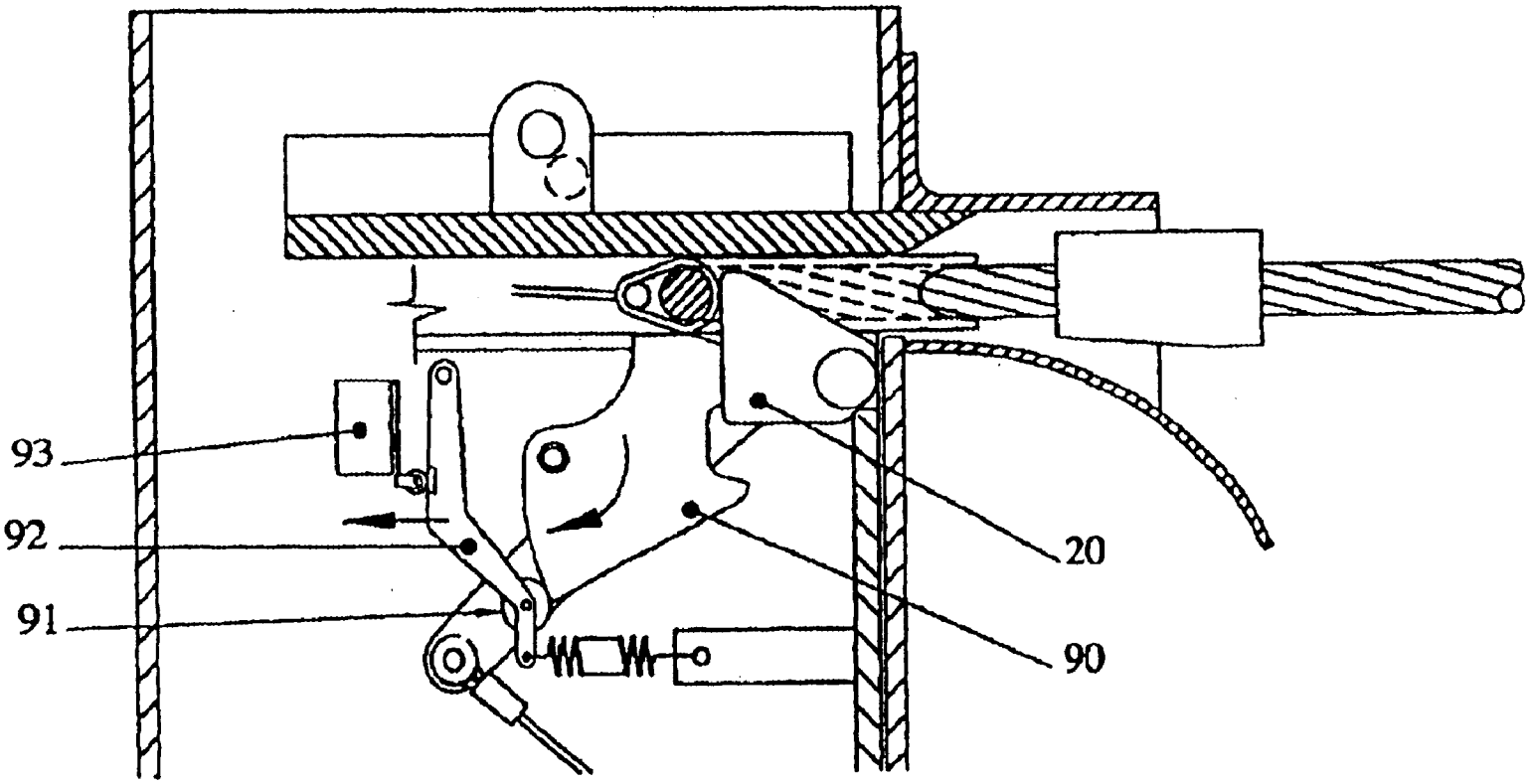
FIG. 9 shows a lock detecting arrangement of the preferred embodiment.

In the preferred embodiments, the gate will include a sensor to detect when the latch and thimble (7) are in a locked position, such that the drive motor may be disengaged. This can be achieved through the arrangement of FIG. 9 which shows how the presence of the thimble (7) can rotate the lock sensing cam (90) against the sensing cam follower (91), causing the follower swing arm (92) to activate the lock micro-switch, thereby signaling the controller (11) that lock has been achieved. Note that lock should not be indicated if either the thimble is not in place, or the latch is not in the locked position, as both of these conditions must be met for the gate to be truly locked.

That is a cam surface carried on the latch pin assembly is generated to form a radius about the pivot point of that pin assembly in the absence of the cable thimble. A spring-loaded cam follower, mounted on a swing arm attached to the frame of the gate mechanism, is arranged to just clear this cam surface. However, if the cable thimble is in place when the latch pin is raised, the cam is caused to rotate to a position outside of the original radius. This in turn causes the cam follower to be activated, which motion may be easily sensed using a fixed micro-switch.

This therefore allows for the use of a single, fixed, micro-switch to reliably detect both that the latch is in the locked position, and that the cable thimble is in place.

To ensure that the locking thimble (7) will enter the master post (5) correctly, then ideally the thimbles located at either end of the main cable (1) should be oriented at right angles to each other. This is difficult to achieve when manufacturing the cables. However, it has been found possible to achieve the ideal configuration through the use of a length of hollow tube, split longitudinally at each end, that is clamped onto the cable. By slightly unwinding the cable strands until the thimbles have the correct orientation, then clamping the split ends onto the cable, the ideal relationship may be achieved. Conveniently, this hollow tube may also perform the function of the spreader bar (10), used for the traction means.

During development it was found that a point is reached during the opening cycle, once sufficient chain or cable (1) has reached ground level, when friction between the cable (1) and the ground (4) (or road surface) will hold the remaining chain or cable (1) away from the passive post (2) and thereby results in the opening width for traffic flow between the gateposts (2, 3) being effectively reduced.

Figure 4B:
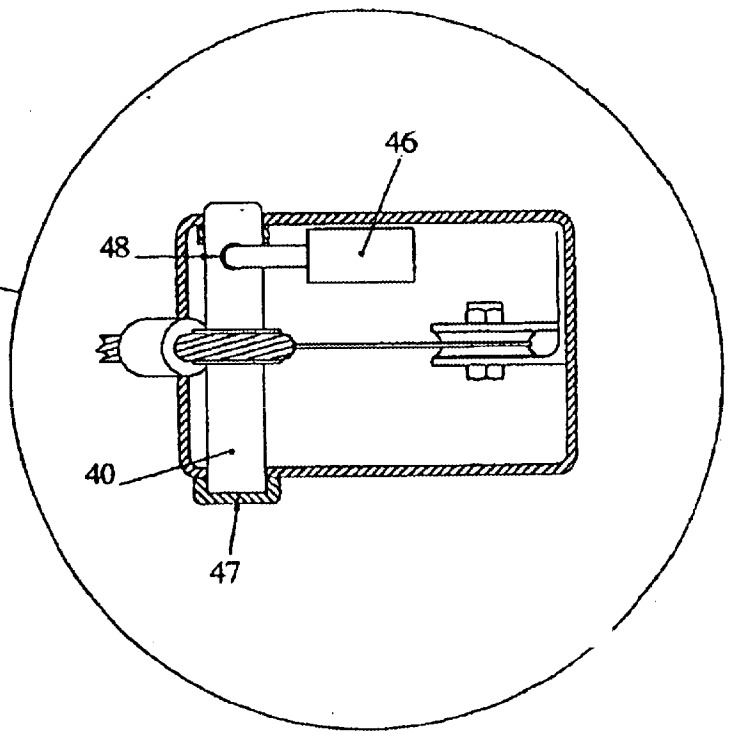
FIGS. 4*a* and 4*b* show the operation of a counterweight in the preferred embodiment.
Figure 4B:
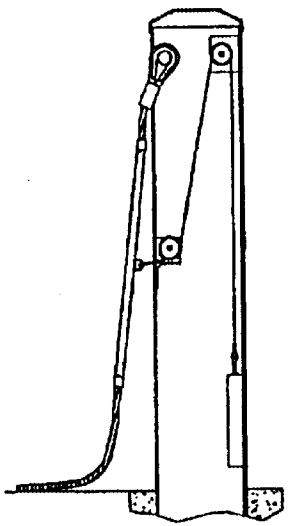
Figure 4A:
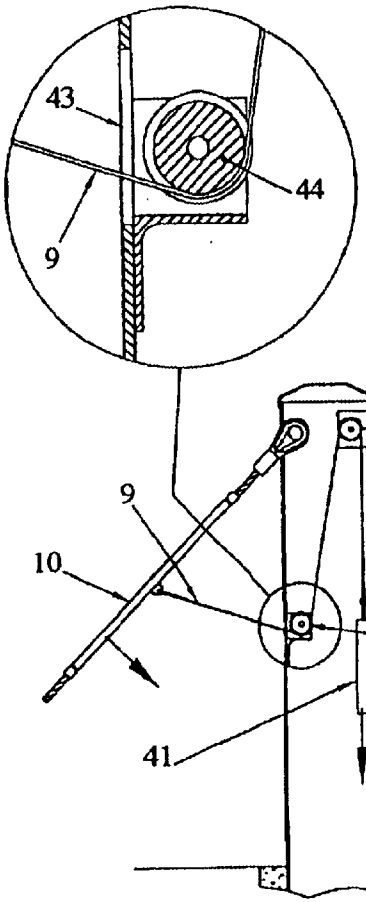

In the preferred embodiment, and referring to FIGS. 4*a* and 4*b* as the main cable (1) is lowered by the master post (3), a counter-weight (41) inside the passive post (2) is able to pull in the cable (1) against that post (2). This may be achieved via a small access hole (43) in the passive post (2), a counter-weight cable (9), and one or more small pulleys (44). Similarly, as the main cable is raised to close the gate, tension in that cable (1) acts through the counter-weight cable (9) to raise the counter-weight (41) to its normal (closed gate) position. A spreader bar (10) attached to the cable (1) can further improve the ability of the main cable to retract along the side of the passive post (2), ensuring that the cable (1) is drawn well into position adjacent to the post (2), for the full height of that post (2), thereby providing a greater effective opening between the posts.

In an alternative arrangement springs may be used in place of the counterweight (41), however, in the preferred embodiment a counterweight is used.

Operation of the counterweight system (refer to FIGS. 4*a* and 4*b*) is a little subtle, and works better than the spring alternative. Firstly, with the gate in the raised position the counterweight cable tension is applied obliquely to the main cable (1), thereby having less effect on the symmetry of the main cable (1) than if loading the cable at right angles. When the gate is first released, the counterweight (41) commences to accelerate rapidly downward and develops a high velocity. Then, when the main cable (1) falls to the ground, the combined action of both the weight of the counterweight (41), and its now considerable inertia acting at near right angles on the spreader bar (10), is used to draw the main cable neatly up against the passive post (2).

A further alternative is to include a bar as part of the cable. That is, the cable can be connected to a bar which is pivotally attached to the post (2). The cable (1) and the bar then combine to extend across the opening. When the cable is released, the weight of the bar would assist in causing the bar to pivot down along the side of the post (2), thereby drawing the cable (1). Alternatively, rather then being pivotally attached to the post (2), the bar could be joined to the post by a length of cable attached to the post and the bar.

As previously noted conventional gates are slow to open. In a preferred embodiment the present invention provides a gate having safe, short opening times. This can be achieved as no hazard is presented by rapid opening of the gate, and gravity may be utilised to effect the short opening time.

Figure 5A:
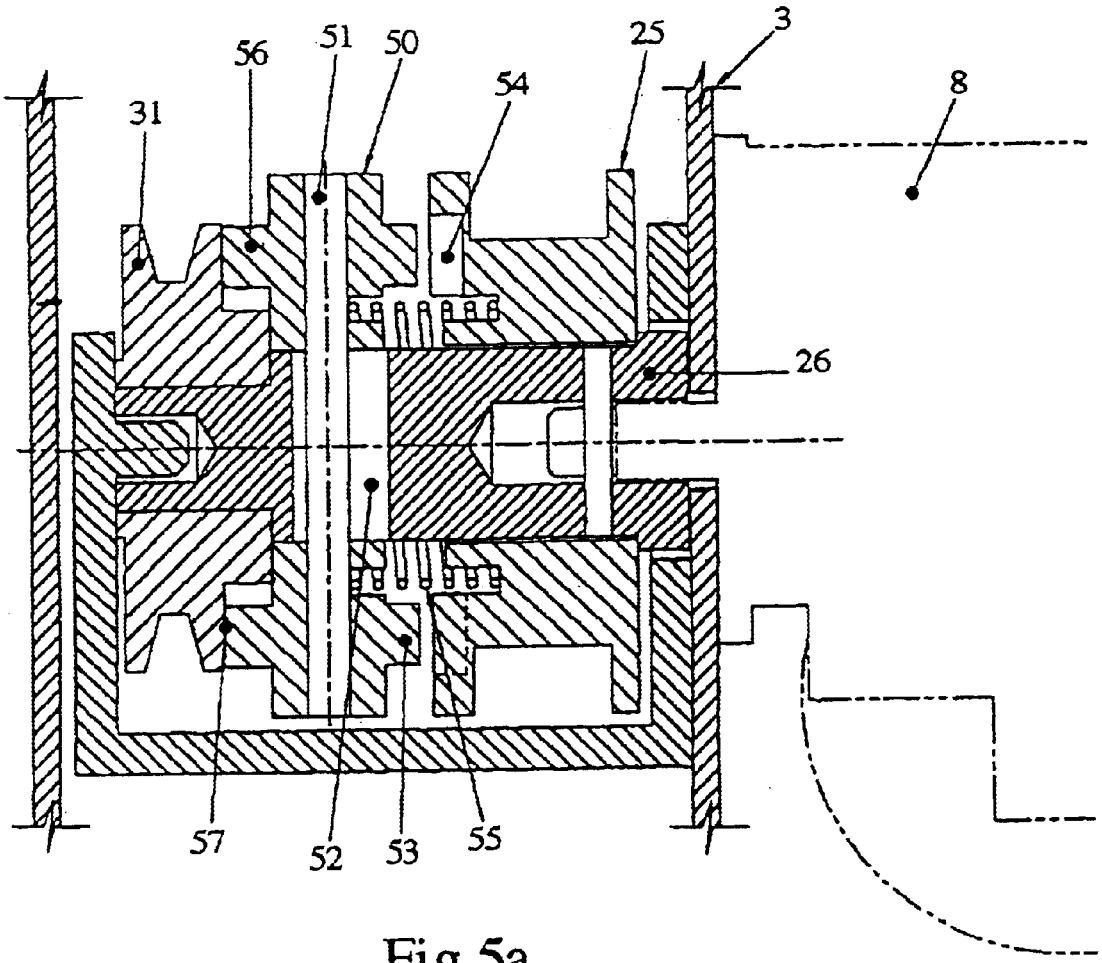
FIG. 5*a* shows a cross section of the gate clutch system.

In the arrangement shown in FIG. 5*a*, the winch drum (25) is made free to rotate on the driven shaft (26). A separate drive collar (50) is attached to the shaft (26) in such a manner that it is forced to rotate with the drive shaft (26), but is free to slide along part of its length. In the preferred embodiment, the collar (50) is located on the shaft (26) by means of a pin (51) passing through a slot (52) in that shaft (26). Alternatively, however, a spline joint or similar arrangement could be provided. This drive collar (50) is provided with extending dogs (53) that may be engaged into recesses (54) in one of the winch drum (25) end flanges, and a spring (55) is used to hold the winch drum (25) and drive collar (50) apart. This provides a form of dog clutch between the motor driven shaft (26), and the winch drum (25).

Figure 5B:
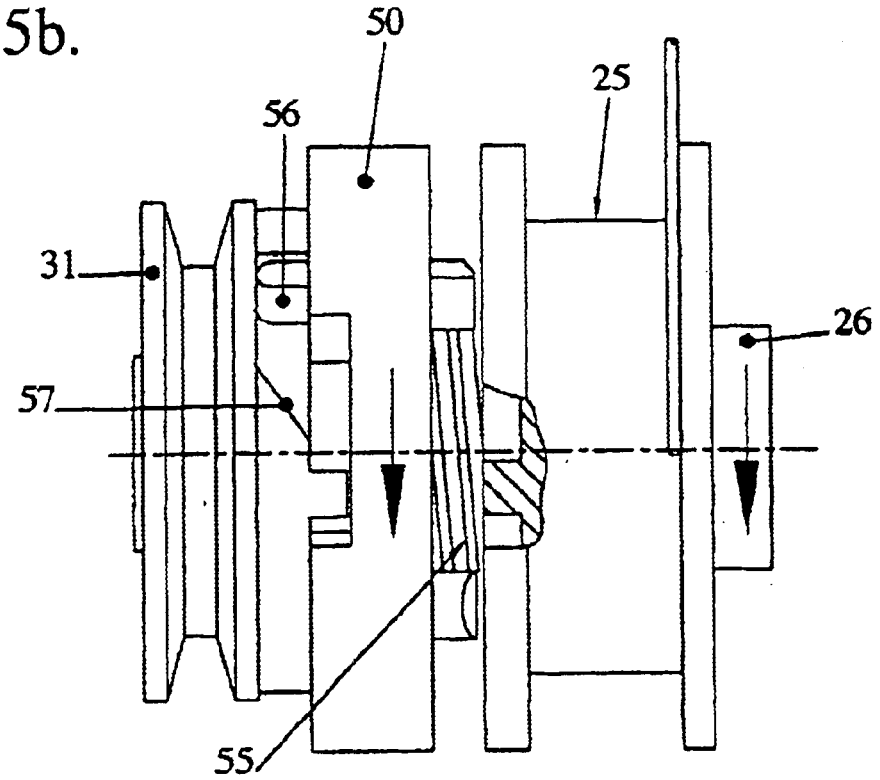
FIG. 5*b* shows the clutch disengaged.
Figure 5C:
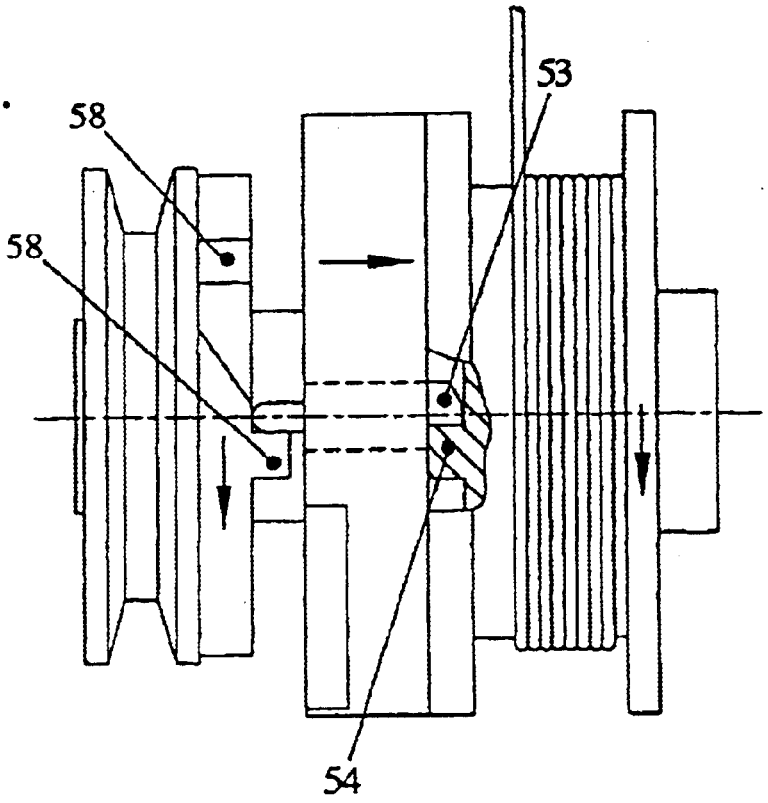
FIG. 5*c* shows the clutch engaged.

The opposite side of the drive collar (50) is provided with extending cam followers (56), which engage with a face cam and hub assembly (57) also mounted on the drive shaft (26). The face cam and hub assembly (57)is also free to rotate on the drive shaft (26), but only over a limited range of travel. This may conveniently be done by providing travel limit surfaces (58), against which the cam followers (56) are able to react (refer FIG. 5*c*). By applying a suitable retarding force (eg. via a friction brake block, or similar), the face cam (57) will be prevented from rotating as the drive shaft rotates, causing it to remain stationary until its travel limit (58) is reached relative to the drive collar (50). Thereafter, the face cam (57) and drive shaft (26) will rotate together. As will be seen, this cam arrangement is used to automatically engage and disengage the winch clutch, thereby coupling and decoupling the drive shaft (26) from the winch drum (25). Conveniently the face cam (57), and the V-belt pulley (31) previously described, could be manufactured as one unit. By this means the V-belt pulley (31) is able to provide the necessary cam retarding force, thereby doing away with the need for a separate retarding system. It will be appreciated that other arrangements to engage the clutch are also possible, and the various cam and clutch elements could equally be swapped between components. For example, the clutch dogs could form part of the winch drum, and the clutch recesses could be manufactured in the drive collar.

In the preferred embodiment, and starting with the gate fully open, this quick release improvement operates as follows.

Referring to FIG. 3*a*, the motor drive will commence rotating the drive shaft (26)anti-clockwise, and the V-belt pulley (31) and face cam (57) assembly will rotate with the shaft (26) and drive collar(50) until the forces in springs A (32) and B (33) become approximately equal. As further rotation occurs, the face cam (57) will tend to be held stationary by the V-belt pulley (31). However, the drive shaft (26) and drive collar (50) will continue to rotate (refer FIG. 5*b*). Therefore, the drive collar cam followers (56) will be caused to move up the ramp of the face cam (57), forcing the drive collar (50) to slide along the drive shaft (26) towards the winch drum (25) (refer FIG. 5*c*). By this means, the clutch dogs (53) are caused to engage with the respective recess (54) of the winch drum (25). This forces the winch drum (25) to be rotated, drawing in the pull-in cable (6). The travel limits (58) on the face cam (57) prevent the cam followers (56) from travelling beyond the point of maximum lift and force the pulley (31) to rotate with the other components. This causes spring A (32) to stretch, allowing the latch (20) to remain closed.

From this point the drive shaft (26), face cam (57), V-belt pulley (31), drive collar (50), and winch drum (25) all continue to rotate as one. This process continues until the main cable (1) is locked into the master post (3) by the latch assembly (20), at which time the gate control system (11) stops the drive motor (8).

To cause a very rapid opening of the gate, the control system starts the drive motor (8) in the opposite (in this case clockwise) direction (refer FIG. 3*b*), when the following sequence of actions occur.

Firstly, the spring forces equalise as all components rotate as one, and the pull-in cable (6) tension is released. However, the main cable (1) is not released at this time. Next, the V-belt pulley (31) and face cam (57) assembly is again held stationary as the drive shaft (26) and collar (50) continue to rotate. This allows the cam followers (56) to move down the cam faces (57), thereby allowing the clutch spring (55) to disengage the clutch dogs (53) from the winch drum (25). Finally, however, the face cam travel limits (58) are again reached, and the face cam (57) and V-belt pulley (31) assembly is caused to commence to rotate although the winch drum (25) is free. This action causes spring B (33) to be stretched, and the V-belt (30) to pull the latch release cable (24), thereby unlatching the main thimble (7) and cable (1). The control system (11) can stop the motor drive (8) at this point. Because the winch drum (25) is now free to rotate, the main cable (1) rapidly falls away under the action of gravity, towing the pull-in cable (6) with it. This completes the entire closing and opening cycle.

Figure 10A:
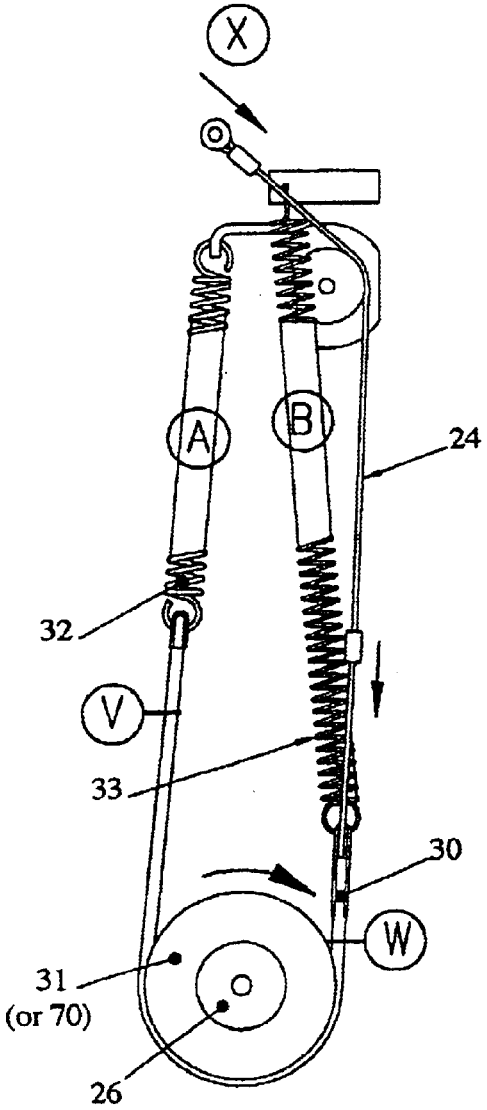
FIGS. 10*a* and 10*b* show the principal of the V-belt arrangement.
Figure 10B:
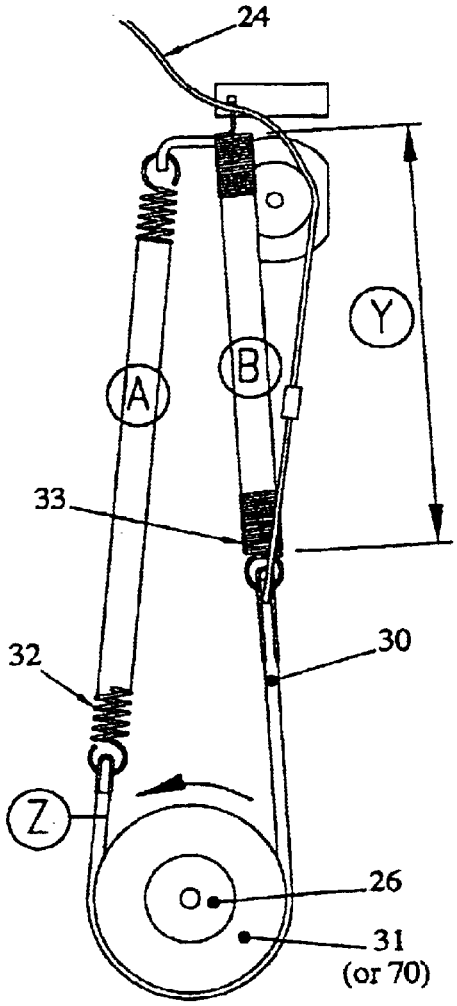

In summary, in a "neutral" or unloaded condition, both the balance springs (32, 33) are under tension. These apply load to each end of the V-belt (30), which is wrapped around the main drive pulley (31). Referring to FIG. 10A which exemplifies the "unlocking action". Here, a significant spring tension is being applied to the V-belt at point "V", and the pulley is being rotated clockwise (by the main drive shaft (26)). Under this condition, the V-belt (30) is able to develop an extremely large tension force at point "W", due to an exponential increase of force as the belt (30) wraps around the pulley (31). A "latch release cable" (24), shown at "X", may generate a very high force, if necessary, to release the gate latch (20)

Similarly, when the pulley (31) is rotated anti-clockwise, a point is reached when spring B (33) collapses to its solid height ("Y"), and spring A (32) has stretched to point "Z". Spring B(33) will then be exerting very little tension on the V-belt (30), approaching zero. The V-belt (30) will then commence to slip on the pulley (31), while spring (32) remains stretched to point "Z". The drag torque on the pulley (31) will be approximately the force at "Z", times the pulley radius.

Figure 6:
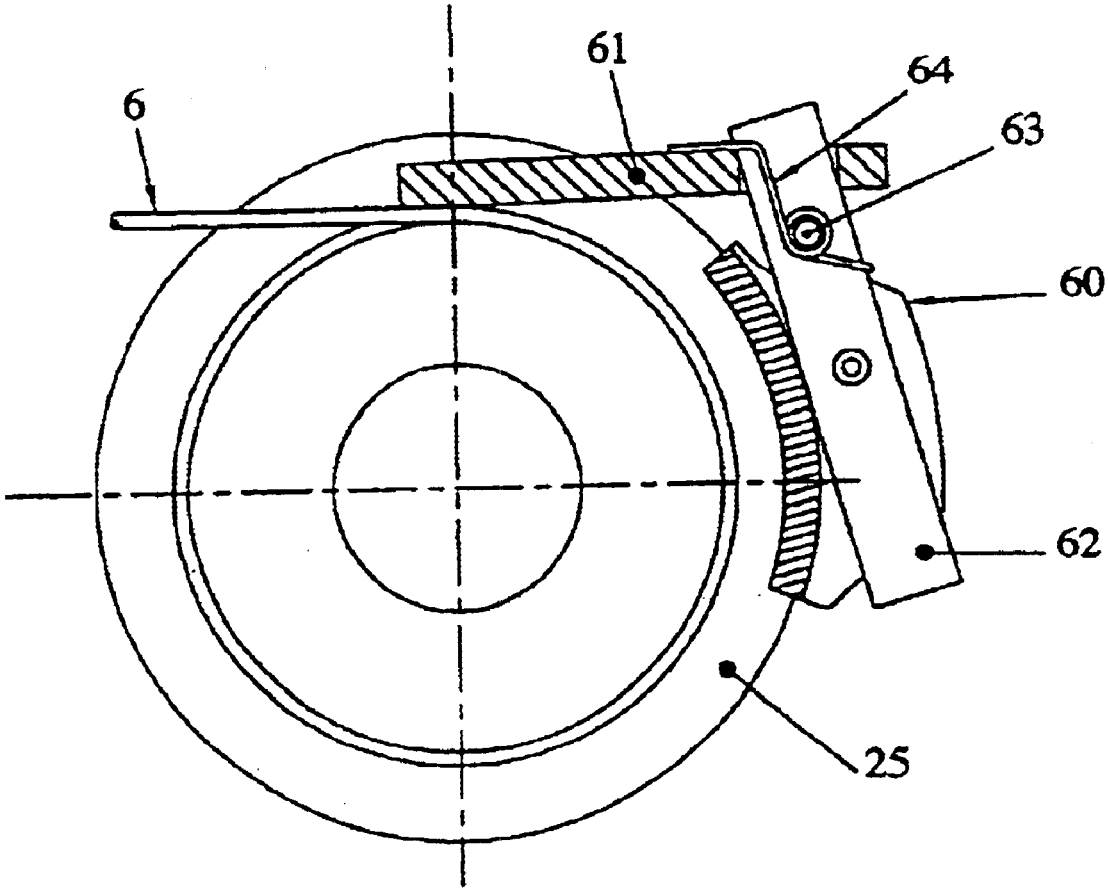
FIG. 6 shows the winch braking arrangement.

During opening of the gate, as the winch drum (25) is free to rotate, it has been found that a brake block (60) applied to the winch drum (25), is useful to prevent uncontrolled reeling of the pull-in cable (6). Refer to FIG. 6. Spring tension may be used to apply the brake force. In addition, a separate finger assembly (61) may be used to clamp the pull-in cable (6) against the winch drum (25), to keep the cable (6) tightly coiled on that drum (25). This helps the cable (6) to reel evenly, thereby prolonging it's operating life. Conveniently, a single spring (64) may be used for applying force both to the brake block (60), and to the coiling control finger (61) unit. FIG. 6 shows one format of this arrangement which both brakes the winch drum (25) and keeps the pull-in cable (6) tightly and neatly wound on the winch drum (25).

It has been found that longer main cable spans require greater braking forces to achieve optimum gate performance. A brake spring (64) that is too strong will prevent the cable from falling fully to ground level, whereas too weak a spring will draw excess pull-in cable (6) from the mechanism. Accordingly, a small number of springs of differing wire diameter have been made, to cover the range of cable spans.

The above quick release mechanism uses a small fraction of the V-belt drag torque to actuate the clutch. As the torque is increased, the pulley (31) is retarded, carrying with it the cam faces (57). In turn, the drive collar (50) is forced along the shaft (26) (as it is unable to rotate on the shaft (26)) by the associated cam followers (56). This engages the clutch, which then commences rotation of the winch drum (25), reeling in the "pull-in" cable (6). A spring (55) is utilised to disengage the clutch following this stage.

In some environments, the above configuration may not be optimum. For example, if the pulley (31) were to become excessively tight on the shaft (26) for any reason, or the collar (50) prevented from easily sliding along the shaft (26) (e.g. due to sand contamination), then a point may be reached when the V-belt (30) commences slipping (at "Z"), before the clutch (53) has engaged. In this circumstance, the drive (26) would continue to rotate, but the winch drum (26) would not be rotated to reel in the "pull-in" cable (6). Accordingly, the gate would fail to lock. Alternatively, the clutch may fail to disengage if the collar (50) becomes jammed with sand.

Figure 7A:
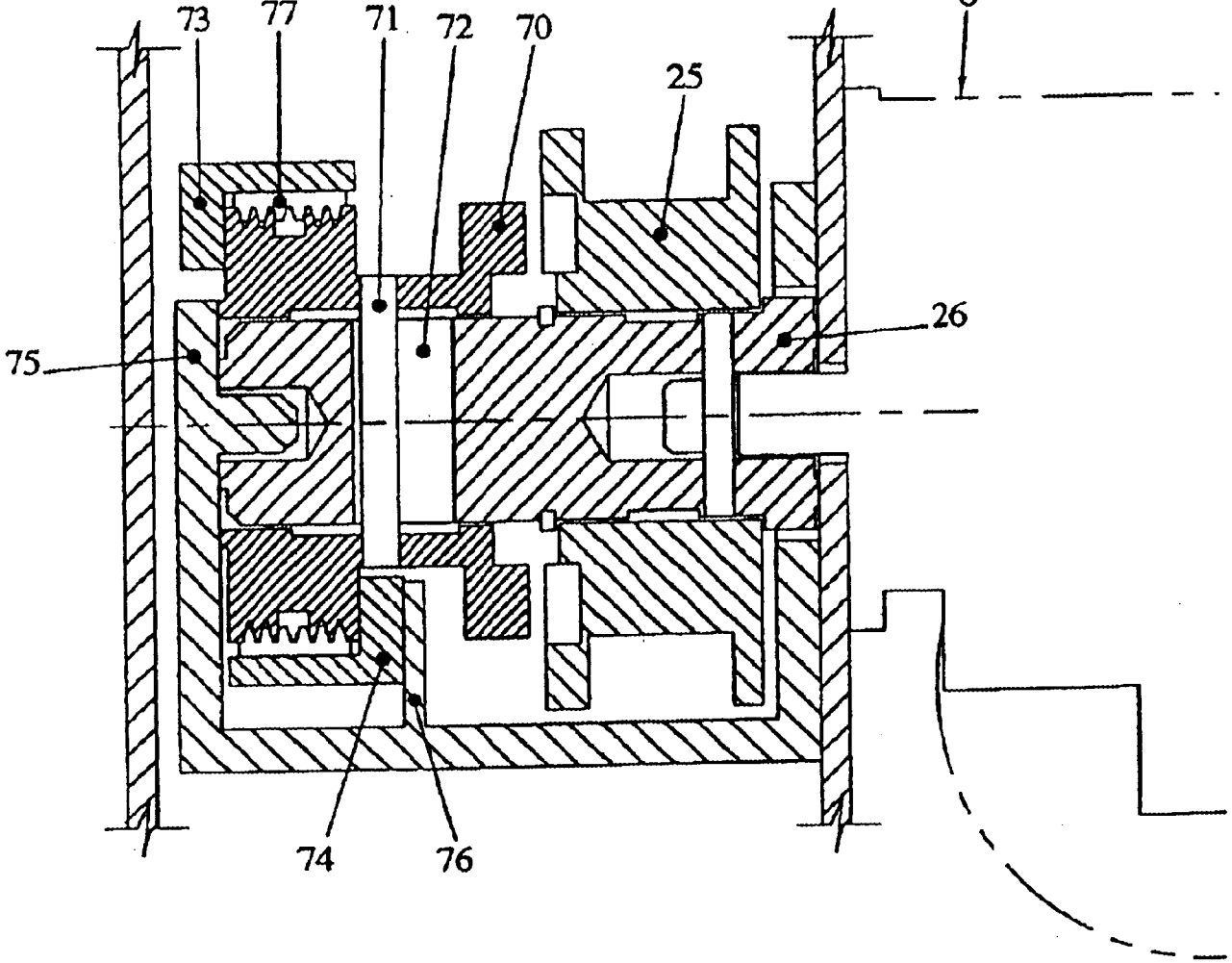
FIG. 7*a* shows a cross section of an alternative clutch system.
Figure 7B:
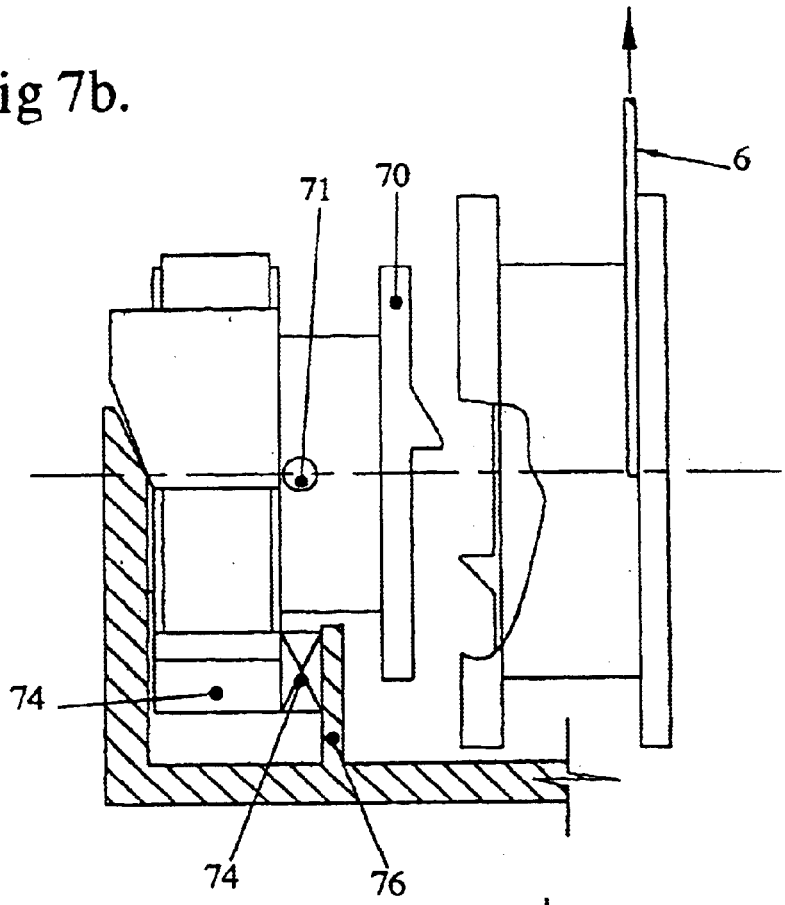
FIG. 7*b* shows the clutch disengaged in the alternative arrangement of FIG. 7*a*.
Figure 7C:
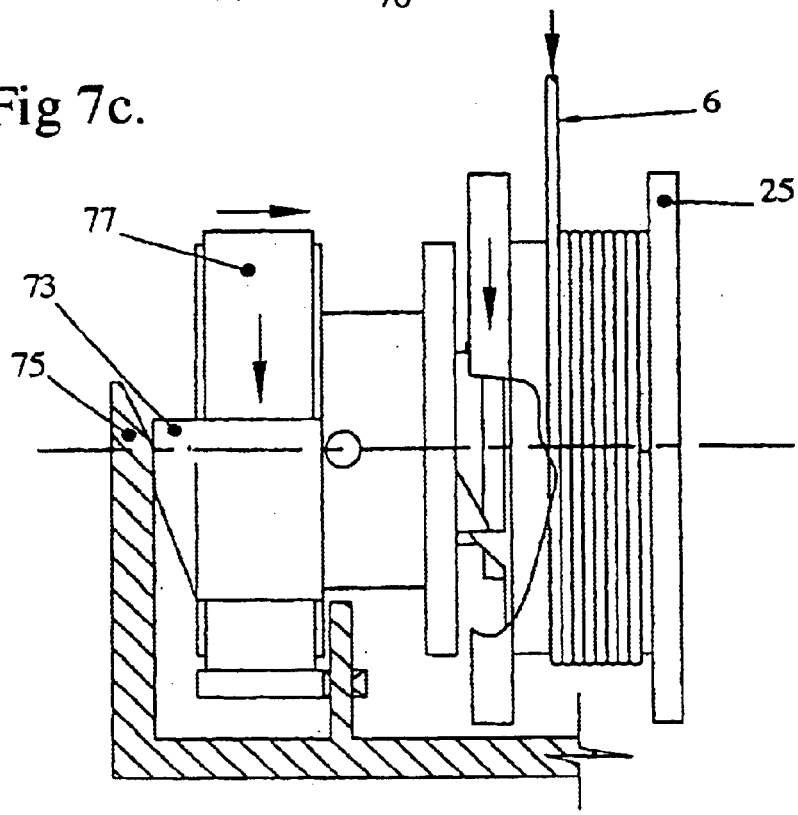
FIG. 7*c* shows the clutch engaged in the alternative arrangement of FIG. 7*a*.

Whilst, in some circumstances, a shroud around the operational components may be sufficient protection from environmental contamination or the like, in extreme conditions an alternative arrangement, as shown in FIGS. 7*a* to 7*c*, may be adopted. In this arrangement, the main pulley and clutch dogs are integrated into one unit (70), which is free to slide along the main drive shaft (26), but forced to rotate with it. This is accomplished by machining a slot (72) in the shaft, through which a pin (71), pressed into the pulley (70), passes. Although other arrangements would be known to the person skilled in the art, for example, a sliding keyway.

At least two cams (73, 74) and two reaction plates (75, 76) are provided for this arrangement. One cam (73) and reaction plate (75) act to engage the clutch, and the other set (74, 76) to disengage the clutch. The cams (73, 74) are rigidly attached to the V-belt (77). The "disengage" cam is the same as the "engage" cam, but reversed on the V-belt (77).

FIG. 7*a* shows a cross-section of the alternative clutch system. The combined poly-V belt pulley and clutch dog collar (70), is forced to rotate with, but free to slide along, the drive shaft (26). FIG. 7*b* shows the clutch disengaged from the winch drum (25) such that the winch drum (25) is therefore free to unreel the cable (6) for the "quick release" function. The disengage cam (74) acts against its' reaction plate (76) to hold the clutch dogs (70) out of engagement. Referring to FIG. 7*c* the belt (77) drives the engage cam (73) against the beveled edge of the engage reaction plate (75) to force the combined pulley and dog collar (70) along the shaft (26) into clutch engagement. Thereafter the belt (77) slips on the pulley (70) and the pull-in cable (6) is able to reel in, to lock the gate. The reverse drive direction forces the clutch to disengage to release the winch (by the same action), and the belt to open the latch (as previously described)

In the previous embodiment, the V-belt pulley (31) was free to rotate about (over a limited range of travel), but not to slide along the main drive shaft (26). This pulley (31) carried with it one or several face cam (57) surfaces. A separate drive collar (50) carried cam followers (56) on one face, and clutch dogs (53) on the other. This collar (50) was made free to slide along, but not rotate about the drive shaft (26), and arranged so that the cam followers (56) would engage with the pulley-supported cams (57). By this means, the action of the belt (30) on the pulley (31) would force the clutch dogs (53) into engagement with a winch drum (25) when rotated in one direction, but allow a spring (55) to disengage the clutch when operated in the other direction.

The alternative arrangement provides a clutch action which is far more positive. In this arrangement, the pulley (70), which may conveniently be made of aluminium, carries with it the clutch dogs. The pulley (70) is made free to slide along, but is forced to rotate with the drive shaft (26). At least two cams (73, 74) are directly attached to the belt (77), at least one to engage the clutch, and at least one to disengage the clutch. These cams (73, 74) act against "reaction plates" (75, 76).

Referring to FIG. 7*b* which clearly shows the clutch dog out of engagement with the winch drum. If the pulley (70) is now rotated (refer FIG. 7*c*), it is clear it will carry with it the belt (77), and the associated cams. The "engage" cam (73) will act against its reaction plate (75), thereby forcing the pulley and clutch dogs (70) along the shaft (26), to engage with the winch drum (25). Note that the "disengage" (74) and "engage" (73) cams must have clearance between their operating zones, to avoid Jamming. That is, the disengage cam (74) must be in the process of moving out of the way before the engage cam (73) starts moving the pulley (31) along the shaft. The reverse also applies.

A further improvement has been to have the flanks of the cams extend down each face of the pulley. This causes the cam actuating loads in the axial direction, to be carried directly from the cams to the pulley, rather than via the belt. As these forces may be quite high in some circumstances, this improvement acts to improve belt strength and life, and to prevent the belt from being lifted or twisted from the pulley.

For convenience, the V-belt may be replaced with a poly V-belt, which simplifies the means of attachment of the cams to the belt, as well as allowing a significant improvement to the way the springs may be attached.

Whilst this arrangement is more expensive to manufacture than the alternative arrangement, this clutch design does provide a more positive clutch action. Recalling the capstan principle, it becomes clear that the belt is able to exert a very large force onto the cams, ensuring the clutch will both engage, and disengage as required.

Referring to FIGS. (7C) and 10B as the pulley (31) rotates anti-clockwise we see the engage cam (73) will be strongly forced around the pulley (70) (by the belt (77)), until the spring B (33) closes to its solid height (and "unloads" the belt). But the belt (77) will not be able to unload until the cam (73) has reached its final position, alongside its corresponding reaction plate (75). At this point, the clutch must be engaged.

The reverse applies. The disengage cam (74) must disengage the clutch before balance spring A (32) can become unloaded.

Such a quick release system could result in the gate opening in less than one second. It would not be practical to provide this level of performance in a conventional gate system, Further, this arrangement saves a considerable power consumption, allowing the gate to be utilised in applications which are power sensitive. In the preferred embodiment, the inclusion of the quick release mechanism also improves the operation of the counterweight mechanism. As the main cable (1) rapidly drops following release, it initially allows the counterweight (41) to almost "free fall" building up a high speed. Because of this speed, when the main cable (1) reaches the ground, the inertia of the falling counterweight (41), in combination with its weight, is very effective in drawing the main cable (1) up tight to the passive post (2), thereby ensuring the maximum opening of the gate.

In order to operate smoothly, it is highly preferable for the main (1) and pull-in (6) cable to run centrally into the master post (3), but for the winch drum (25) to be located with considerable offset from the centre line. This arrangement provides better internal space for the various other gate mechanisms. Further, the pull-in cable (6) should be fed onto the winch drum (25) in such a manner that it reels on neatly and evenly.

Additionally, it is useful for the gate control system (11) to be able to sense an overload condition, thereby allowing appropriate control action to be taken in this event.

Figure 8A:
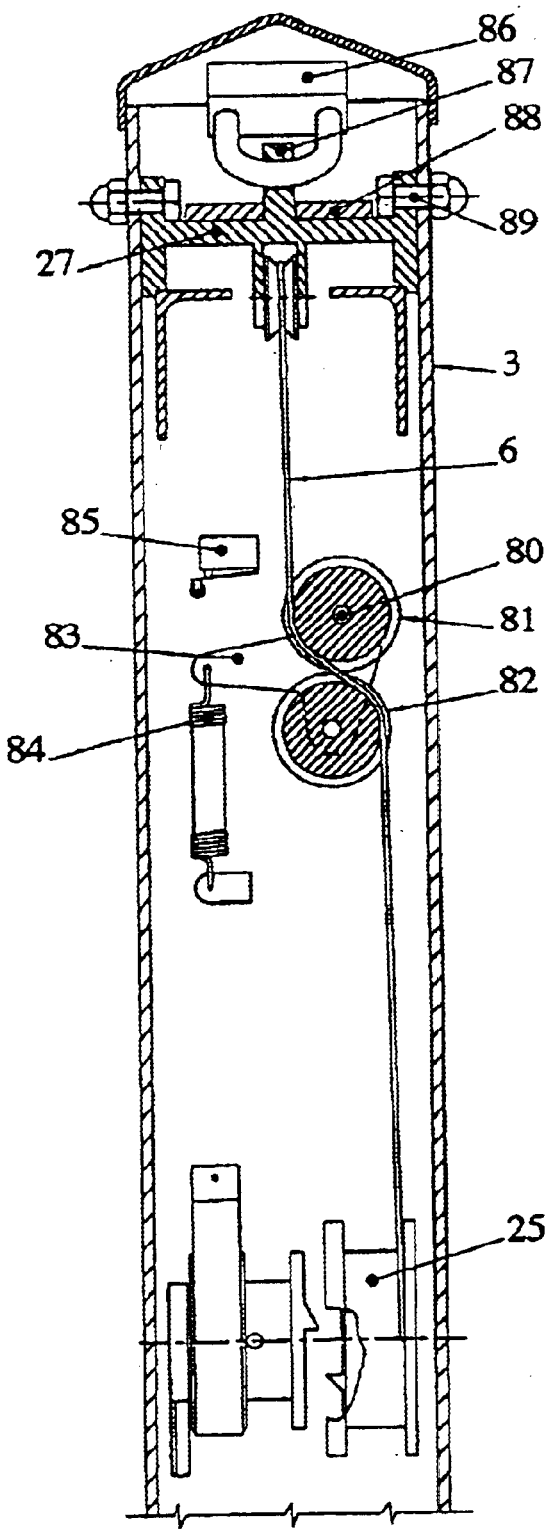
FIGS. 8*a* and 8*b* show a tracking system and overload sensing arrangement of the preferred embodiment.
Figure 8B:
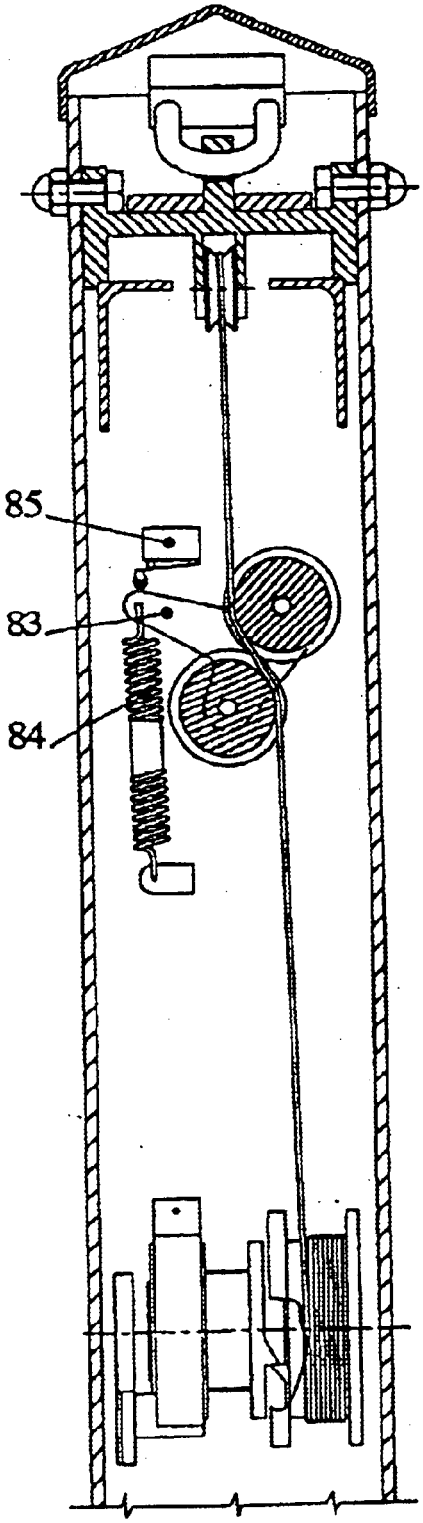

Referring now to FIGS. 8*a* and 8*b*, in order to achieve this a simple fixed pulley (81) is used to re-direct the pull-in cable (6) (from the center-line) around a second pulley (82) mounted on a spring-loaded swinging arm (83). By this means, at low loads the pull-in cable (6) alignment may be offset to one side of the winch drum (25), but as the cable load increases then the swinging arm (83) will pivot about an overload pivot (80) to cause the pull-in cable (6) to track across the winch drum (25) surface. A limit stop is ideally provided to establish the minimum load position, and the selected spring (84) characteristic determines the rate at which the cable is offset verses load. A limit switch (85), for example an overload micro-switch, may be provided to detect abnormally high cable loads, and used as an input to an associated control system able to cut power to the drive, re-open the gate, or take other appropriate control action.

It is a characteristic of the cable gate of the preferred embodiment, that the pull-in load required to close the gate will initially be small, but will increase to a maximum level once the gate is fully closed. Similarly, the cable should be tracked across the winch drum at the rate of one cable width per drum rotation.

Through the selection of an appropriate spring design, the present invention is able to approximately match these two characteristics. That is, as cable is reeled in and the main cable is raised, then the increasing cable tension forces will cause the cable to be tracked across the winch drum at an approximately correct rate. Therefore, the cable will be reeled in neatly and evenly, and abnormally high loads will be detected by the limit switch.

FIGS. 8*a* and 8*b* show the action of this tracking system, and overload sensing. As the cable load increases, the overload swing arm (83) rotates to track the pull-in cable (6) across the winch drum (25) surface. If excessive load is encountered, the arm moves against a limit switch (85) which is able to signal the control system to take appropriate action.

Conveniently, the operating mechanism may be constructed as a complete, pre-tested, self-contained module. This approach simplifies and reduces the cost of maintenance activities, as the module may be replaced in the field, and repaired in a suitable workshop. To allow easy and rapid module replacement, while still preventing unauthorised access, and also supporting the very high loads that are developed should attempts be made to breach the gate, a locking plate system was developed. Firstly, the heavily constructed top plate (27) of the module is arranged to fit into the entry mouth hole in the master post (refer FIG. 3*a*). Then, high strength bolts (89) are fitted, from the inside, through holes in the top plate, and the post. A locking plate (88) is arranged to drop over a tang (87) welded to the top plate, between the bolt heads, so as to prevent withdrawal of the bolts. Finally, a padlock (86) is fitted to this tang, to prevent the removal of the locking plate.

Referring to FIGS. 8A and 8B, with the locking plate and padlock in place, the retaining bolts (89) may not be removed, so the top plate (27) and associated operating module may not be accessed.

The main cable (1) may typically be retained in the passive post (2) by means of a heavy steel anchor pin (40) (refer FIG. 4*b*). Removal of this pin (40) allows the main cable (1) to be lowered to the ground (4) thereby providing for emergency access in the event of failure of the main drive mechanism. To prevent unauthorised access, this pin (40) may in turn be held in place through the use of a padlock (46). An arrangement has been devised that achieves the above objectives, whilst conferring several other advantages. In this arrangement, the anchor pin (40) passes through a hole in one side of the post (2), and into a "blind" recess (47), located on the other side of the post (2). The padlock (46) is then locked into a cross-hole (48), in the anchor pin (40) located inside the post (2), to prevent withdrawal of the pin (40). By this means, the padlock (46) is at least partly protected from deliberate abuse, and is sheltered from the weather. Also, access to the anchor pin (40) is restricted, preventing it from being driven against the hasp of the padlock (46).

In certain applications, the functionality of a cable gate may be enhanced using multiple cables, signs, and panels etc. These additional features would be attached to (or may form part of the main cable, and could be raised by it. The only requirements should be that the attached components must allow the main cable to slide through them, they must collapse fully to ground level, and they must be compatible with the passage of vehicular traffic over them.

For example, horizontal and vertical cables may be attached, or a sign may be hung from the centre of the gate span (so that vehicle wheels could track either side of the sign). A second (or more) cable(s) may be anchored near the base of both the master and passive posts, and raised by vertical tie cables attached to the main cable by sliding joints. When opened, the main cable would slide through these vertical ties, allowing the entire assembly to drop to the road surface.

Alternatively, the main cable may be anchored at a low point on the master post, but pass through pulleys spaced apart in the passive post, to return to the normal latch position on the master post. When opened, the entire cable would thereby be allowed to drop to ground level.

Some slack must be provided in the main cable so that it may be locked, and is also beneficial should attempts be made to breach the gate due to the way the cable tension acts to retard the vehicle. However, for reasons of safety the cable should ideally not be so high as to allow it to pass over the hood of a vehicle, nor so low that a heavy 4WD vehicle may drive over it. It has been found optimum to support the ends of the cable about 750 millimeters above ground level, with the centre of the cable drooping to about 550 millimeters above the ground.

Modifications and variations to the cable gate of the present invention may be apparent to one skilled in the art upon reading of this disclosure and such modifications form part of the scope of the present invention.

What is claimed is:

1. A gate for controlling passage through an opening including:

a first support means located on one side of the opening;

a second support means located on an opposite side of the opening;

at least one elongate member, having a first and a second end, extendable across the opening between said first and second support means;

a first drive means to draw in said elongate member to thereby restrict passage through said opening;

a control means for coupling and decoupling said first drive means;

wherein decoupling of said first drive means allows for release of said at least one elongate member to thereby enable passage through said opening and coupling of said first drive means allows for drawing in said at least one elongate member to thereby restrict passage through said opening; and a locking means to prevent unwanted release of said at least one elongate member, wherein said locking means includes a latch means adapted to engage a termination means attached to said at least one elongate member.

2. A gate as claimed in claim 1 wherein said termination means is one of a thimble assembly, hook assembly, eye assembly, T-bar assembly and clevises assembly.

3. A gate as claimed in claim 1 wherein said latch means is a pivoting pin.

4. A gate as claimed in claim 1 further including a first line connecting said first end of said at least one elongate member to said first drive means such that said first drive means operates to draw in said first line thereby drawing in said at least one elongate member wherein said first line is attached to said termination means.

5. A gate as claimed in claim 4 wherein said first drive means includes a winch drum adapted to reel in and reel out said first line, said winch drum is adapted to freely rotate on a drive shaft; and said first drive means further includes:

a drive collar rotatable with, and slidable along, said drive shaft; and an engaging means adapted to enable said drive collar to engage and disengage said winch drum; wherein disengaging said winch drum allows for release of said first line, and engaging said winch drum allows for drawing in said first line.

6. A gate as claimed in claim 5 wherein said drive collar is located on said drive shaft by a pin extending through a slot in said drive shaft.

7. A gate as claimed in claim 5 wherein said engaging means includes cooperating extending dogs and recesses on said drive collar and winch drum.

8. A gate as claimed in claim 5 further including a third spring adapted to hold said drive collar and winch drum out of engagement.

9. A gate as claimed in claim 5 wherein said pulley means further includes a face cam adapted to engage said drive collar, such that any imbalance between said first and second spring acts to hold said face cam stationary, and said drive collar is forced by said face cam to move along said drive shaft to thereby engage or disengage said winch drum.

10. A gate as claimed in claim 9 wherein said face cam includes a ramp adapted to cooperate with protrusions on said drive collar.

11. A gate as claimed in claim 4 wherein said first drive means includes a winch drum adapted to reel in and reel out said first line, said gate further including a tracking means to track said first line along said winch drum including:

a fixed pulley;

a second pulley mounted on an arm, said arm being spring loaded and capable of swinging;

wherein said first line tracks around said fixed pulley and said second pulley prior to being wound on to said winch drum.

12. A gate as claimed in claim 11 wherein said tracking means further includes a first limit stop to indicate a minimum load position.

13. A gate as claimed in claim 12 wherein said spring loaded arm holds said second pulley at said first limit stop when said gate is fully opened.

14. A gate as claimed in claim 11 wherein said tracking means further includes a second limit stop adapted to detect an overload condition.

15. A gate as claimed in claim 14 wherein said second limit stop includes a sensor activated by one of said spring loaded arm and said second pulley.

16. A gate as claimed in claim 1 further including a latch release means.

17. A gate as claimed in claim 16 wherein said latch release means includes:

a release lever adapted to release said latch means;

a first and a second spring each fixed at one end;

a belt passing around a pulley means and connecting said first spring to said second spring; and a release line attached to said release lever and said belt.

18. A gate as claimed in claim 17 wherein said release lever further includes a return spring adapted to return said release lever to a locked position.

19. A gate as claimed in claim 17 wherein said release line is a 1.6 mm stainless steel wire rope.

20. A gate as claimed in claim 17 wherein said first drive means includes a winch drum adapted to reel in and reel out said first line, said winch drum is adapted to freely rotate on a driveshaft; and said first drive means further includes: an assembly adapted to slide along and rotate with a drive shaft; said assembly including a clutch dog;

a plurality of cams, including a first and second cam;

a plurality of reaction plates, including a first and second reaction plate;

wherein said first cam is adapted to engage said first reaction plate, to thereby engage said clutch dog with said winch drum; and said second cam is adapted to engage said second reaction plate, to thereby disengage said clutch dog from said winch drum.

21. A gate as claimed in claim 20, wherein flanks on said cams extend down each face of said assembly.

22. A gate as claimed in claim 16 wherein said latch release means is activated by said first drive means.

23. A gate as claimed in claim 1 wherein said latch means includes a latch or locking pin adapted to be released by a release lever; a member attached via a ratchet means to a first drive means; and a release line joining said release lever to said member.

24. A gate as claimed in claim 1, further including a lock detect means adapted to sense when said gate is locked.

25. A gate as claimed in claim 24 wherein said lock detect means includes a sensor to detect when said latch means and said termination means are both in a locked position.

26. A gate as claimed in claim 25 wherein said sensor is activated by said termination means pivoting a sensing cam, mounted on said latch means, into engagement with said sensor.

27. A gate as claimed in claim 1 wherein said first end and said second end of said at least one elongate member are each attached to respective termination means, and said locking means includes respective latching means in said first and second support means to engage the respective termination means.

28. A gate for controlling passage through an opening including:

a first support means located on one side of the opening;

a second support means located on an opposite side of the opening;

at least one elongate member, having a first and a second end, extendable across the opening between said first and second support means;

a first drive means to draw in said elongate member to thereby restrict passage through said opening;

a control means for coupling and decoupling said first drive means;

wherein decoupling of said first drive means allows for release of said at least one elongate member to thereby enable passage through said opening and coupling of said first drive means allows for drawing in said at least one elongate member to thereby restrict passage through said opening; and a first line connecting said first end of said at least one elongate member to said first drive means such that said first drive means operates to draw in said first line thereby drawing in said at least one elongate member, wherein said first drive means includes a winch drum adapted to reel in and reel out said first line, and wherein during opening of the gate said first drive means is decoupled, thereby allowing the weight of said at least one elongate member to extract said first line from said first drive means; said gate further including a braking means to limit the speed of extraction of said first line when said first drive means is decoupled, and a finger assembly adapted to hold said first line against said winch drum.

29. A gate as claimed in claim 28 wherein said first line is attached to the respective termination means.

30. A gate for controlling passage through an opening including:

a first support means located on one side of the opening;

a second support means located on an opposite side of the opening;

at least one elongate member, having a first and a second end, extendable across the opening between said first and second support means;

a first drive means to draw in said elongate member to thereby restrict passage through said opening; and a control means for coupling and decoupling said first drive means;

wherein decoupling of said first drive means allows for release of said at least one elongate member to thereby enable passage through said opening and coupling of said first drive means allows for drawing in said at least one elongate member to thereby restrict passage through said opening, wherein said first and second support means include a security lock system to prevent access to parts within said first and second support means, said security lock system including:

a top plate adapted to fit within at least one of said first and said second support means;

at least one locking pin adapted to pass through said top plate and one of and said first and second support means;

a locking plate adapted to fit over a tang mounted on said top plate and prevent removal of said at least one locking pin; and a second locking means fitted to said tang to prevent removal of said locking plate.

31. A gate as claimed in claim 30 wherein said at least one locking pin is a high strength bolt, and said second locking means is a padlock.

32. A gate for controlling passage through an opening including:

a first support means located on one side of the opening;

a second support means located on an opposite side of the opening;

at least one elongate member, having a first and a second end, extendable across the opening between said first and second support means;

a first drive means to draw in said elongate member to thereby restrict passage through said opening; and a control means for coupling and decoupling said first drive means;

wherein decoupling of said first drive means allows for release of said at least one elongate member to thereby enable passage through said opening and coupling of said first drive means allows for drawing in said at least one elongate member to thereby restrict passage through said opening, wherein said second end of said at least one elongate member is anchored to said second support means by a removable pin, wherein said removable pin is held in said second support means by a third locking means, said third locking means being a padlock located within said first support means.

33. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means;

a control means for releasing said at least one elongate member to thereby enable passage through said opening, and drawing said elongate member towards a first aperture in said first support means; wherein said elongate member remains substantially external to said first support means and little to none of said elongate member enters said first support means when said gate is in a locked or closed position to thereby restrict passage through said opening; and a locking means to prevent unwanted release of said at least one elongate member, wherein said locking means includes a latch means adapted to engage said termination means attached to said at least one elongate member.

34. A gate as claimed in claim 33 wherein said latch means is a pivoting pin.

35. A gate as claimed in claim 33 further including a latch release means.

36. A gate as claimed in claim 35, wherein said latch release means includes:

a release lever adapted to release said latch means;

a first and a second spring each fixed at one end;

a belt passing around a pulley means and connecting said first spring to said second spring; and a release line attached to said release lever and said belt.

37. A gate as claimed in claim 36, wherein said release lever further includes a return spring adapted to return said release lever to a locked position.

38. A gate as claimed in claim 36 wherein said first drive means includes a winch drum adapted to reel in and reel out said first line, said winch drum is adapted to freely rotate on a drive shaft; and said first drive means further includes:

an assembly adapted to slide along and rotate with a drive shaft; said assembly including a clutch dog;

a plurality of cams, including a first and second cam;

a plurality of reaction plates, including a first and second reaction plate; wherein said first cam is adapted to engage said first reaction plate, to thereby engage said clutch dog with said winch drum; and said second cam is adapted to engage said second reaction plate, to thereby disengage said clutch dog from said winch drum.

39. A gate as claimed in claim 38, wherein flanks on said cams extend down each face of said assembly.

40. A gate as claimed in claim 35, wherein said latch release means is activated by said first drive means.

41. A gate as claimed in claim 33 further including a first line connecting said first end of said at least one elongate member to a first drive means such that said first drive means operates to draw in said first line thereby drawing said at least one elongate member towards said first aperture, wherein said first drive means includes a winch drum adapted to reel in and reel out said first line, said winch drum is adapted to freely rotate on a drive shaft; and first drive means further includes:

a drive collar rotatable with, and slidable along, said drive shaft; and an engaging means adapted to enable said drive collar to engage and disengage said winch drum; wherein disengaging said winch drum allows for release of said first line, and engaging said winch drum allows for drawing in said first line.

42. A gate as claimed in claim 41 wherein said drive collar is located on said drive shaft by a pin extending through a slot in said drive shaft.

43. A gate as claimed in claim 41 wherein said engaging means includes cooperating extending dogs and recesses on said drive collar and winch drum.

44. A gate as claimed in claim 41 further including a third spring adapted to hold said drive collar and winch drum out of engagement.

45. A gate as claimed in claim 41 wherein said pulley means further includes a face cam adapted to engage said drive collar, such that any imbalance between said first and second spring acts to hold said face cam stationary, and said drive collar is forced by said face cam to move along said drive shaft to thereby engage or disengage said winch drum.

46. A gate as claimed in claim 45 wherein said face cam includes a ramp adapted to cooperate with protrusions on said drive collar.

47. A gate as claimed in claim 33 wherein said latch means includes one of a latch and a locking pin adapted to be released by a release lever; a member attached via a ratchet means to a first drive means; and a release line joining said release lever to said member.

48. A gate as claimed in claim 33 further including a first line connecting said first end of said at least one elongate member to a first drive means such that said first drive means operates to draw in said first line thereby drawing said at least one elongate member towards said first aperture, wherein said first drive means includes a winch drum adapted to reel in and reel out said first line, the gate further including a tracking means to track said first line along said winch drum including:

a fixed pulley;

a second pulley mounted on an arm, said arm being spring loaded and capable of swinging;

wherein said first line tracks around said fixed pulley and said second pulley prior to being wound on to said winch drum.

49. A gate as claimed in claim 48 wherein said tracking means further includes a first limit stop to indicate a minimum load position.

50. A gate as claimed in claim 49 wherein said spring loaded arm holds said second pulley at said first limit stop when said gate is fully opened.

51. A gate as claimed in claim 48 wherein said tracking means further includes a second limit stop adapted to detect an overload condition.

52. A gate as claimed in claim 51 wherein said second limit stop includes a sensor activated by one of said spring loaded arm and said second pulley.

53. A gate as claimed in claim 33 wherein said first end and said second end of said at least one elongate member are each attached to respective terminations means, and said locking means includes respective latching means in said first and second support means to engage the respective termination means.

54. A gate as claimed in claim 53 further including a first line connecting said first end of said at least one elongate member to a first drive means such that said first drive means operates to draw in said first line thereby drawing said at least one elongate member towards said first aperture, wherein said first line is attached to the respective termination means.

55. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means;

a control means for releasing said at least one elongate member to thereby enable passage through said opening, and drawing said elongate member towards a first aperture in said first support means; wherein said elongate member remains substantially external to said first support means and little to none of said elongate member enters said first support means when said gate is in a locked or closed position to thereby restrict passage through said opening;

a locking means to prevent unwanted release of said at least one elongate member; and a lock detect means adapted to sense when said gate is locked.

56. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means;

a control means for releasing said at least one elongate member to thereby enable passage through said opening, and drawing said elongate member towards a first aperture in said first support means; wherein said elongate member remains substantially external to said first support means and little to none of said elongate member enters said first support means when said gate is in a locked or closed position to thereby restrict passage through said opening; and a locking means to prevent unwanted release of said at least one elongate member, and a lock detect means adapted to sense when said gate is locked, wherein said locking means including a latch means adapted to engage said termination means attached to said at least one elongate member; said lock detect means including a sensor to detect when said latch means and said termination means are both in a locked position.

57. A gate as claimed in claim 56 wherein said sensor is activated by said termination means pivoting a sensing cam, mounted on said latch means, into engagement with said sensor.

58. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means;

a control means for releasing said at least one elongate member to thereby enable passage through said opening, and drawing said elongate member towards a first aperture in said first-support means; wherein said elongate member remains substantially external to said first support means and little to none of said elongate member enters said first support means when said gate is in a locked or closed position to thereby restrict passage through said opening;

a first line connecting said first end of said at least one elongate member to a first drive means such that said first drive means operates to draw in said first line thereby drawing said at least one elongate member towards said first aperture, wherein during opening of the gate said first drive means is decoupled, thereby allowing the weight of said at least one elongate member to extract said first line from said first drive means; and a braking means to limit the speed of extraction of said first line when said first drive means is decoupled, wherein said first drive means includes a winch drum adapted to reel in and reel out said first line, and wherein during opening of the gate said first drive means is decoupled, thereby allowing the weight of said at least one elongate member to extract said first line from said first drive means; said gate further including a braking means to limit the speed of extraction of said first line when said first drive means is coupled, and further including a finger assembly adapted to hold said first line against said winch drum.

59. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means; and a control means for releasing said at least one elongate member to thereby enable passage through said opening, and drawing said elongate member towards a first aperture in said first support means; wherein said elongate member remains substantially external to said first support means and little to none of said elongate member enters said first support means when said gate is in a locked or closed position to thereby restrict passage through said opening, wherein said first and second support means include a security lock system to prevent access to parts within said first and second support means, said security lock system including:

a top plate adapted to fit within at least one of said first and said second support means;

at least one locking pin adapted to pass through said top plate and one of said first and second support means;

a locking plate adapted to fit over a tang mounted on said top plate and prevent removal of said at least one locking pin; and a second locking means fitted to said tang to prevent removal of said locking plate.

60. A gate as claimed in claim 59 wherein said at least one locking pin is a high strength bolt, and said second locking means is a padlock.

61. A gate for controlling passage through an opening including:

a first support means located on one side of the opening;

a second support means located on an opposite side of the opening;

at least one elongate member, having a first and a second end, extendable across the opening between said first and second support means;

a first drive means to draw in said elongate member to thereby restrict passage through said opening;

a control means for coupling and decoupling said first drive means; wherein decoupling of said first drive means allows for release of said at least one elongate member to thereby enable passage through said opening and coupling of said first drive means allows for drawing in said at least one elongate member to thereby restrict passage through said opening;

a first line connecting said first end of said at least one elongate member to said first drive means such that said first drive means operates to draw in said first line thereby drawing in said at least one elongate member;

and wherein said first drive means includes:

a winch drum adapted to reel in and reel out said first line, said winch drum being adapted to freely rotate on a drive shaft;

a drive collar rotatable with, and slidable along, said drive shaft; and an engaging means adapted to enable said drive collar to engage and disengage said winch drum; wherein disengaging said winch drum allows for release of said first line, and engaging said winch drum allows for drawing in said first line;

and wherein during opening of the gate said first drive means is decoupled, thereby allowing the weight of said at least one elongate member to extract said first line from said first drive means.

62. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means;

a control means for releasing said at least one elongate member to thereby enable passage through said opening, and drawing said elongate member towards a first aperture in said first support means; wherein said elongate member remains substantially external to said first support means and little to none of said elongate member enters said first support means when said gate is in a locked or closed position to thereby restrict passage through said opening;

a locking means to prevent unwanted release of said at least one elongate member; said locking means including:

a latch means adapted to engage said termination means attached to said at least one elongate member;

a latch release means activated by said first drive means; and wherein said release means further includes a return spring adapted to return said release means to a locked position.

63. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means;

a first drive means to draw in said elongate member to thereby restrict passage through said opening; and a control means for coupling and decoupling said first drive means; wherein decoupling of said first drive means allows for release of said at least one elongate member to thereby enable passage through said opening and coupling of said first drive means allows for drawing in said at least one elongate member towards a first aperture in said first support means to thereby restrict passage through said opening; wherein said at least one elongate member remains substantially external to said first support means and little to none of said elongate member enters said first support means when said gate is in a locked or closed position to thereby restrict passage through said opening;

a first line connecting said first end of said at least one elongate member to said first drive means such that said first drive means operates to draw in said first line thereby drawing in said at least one elongate member;

a locking means to prevent unwanted release of said at least one elongate member; said locking means including:

a latch means adapted to engage said termination means attached to said at least one elongate member;

a latch release means activated by said first drive means;

wherein said release lever further includes a return spring adapted to return said release lever to a locked position, and wherein said first drive means includes:

a winch drum adapted to reel in and reel out said first line, said winch drum being adapted to freely rotate on a drive shaft;

a drive collar rotatable with, and slidable along, said drive shaft; and an engaging means adapted to enable said drive collar to engage and disengage said winch drum; wherein disengaging said winch drum allows for release of said first line, and engaging said winch drum allows for drawing in said first line; wherein during opening of the gate said first drive means is decoupled, thereby allowing the weight of said at least one elongate member to extract said first line from said first drive means.

64. A gate for controlling passage through an opening including:

a first support located on one side of the opening;

a second support located on an opposite side of the opening;

at least one elongate member, having a first and a second end, extendable across the opening between said first and second supports, said elongate member having a released state in which passage through said opening is substantially unrestricted and a drawn-in state in which passage through said opening is substantially restricted;

a first drive attached to one of said first and second supports and having selective coupled and decoupled states, said first drive being engaged with said elongate member, said elongate member being drawn into its said drawn-in state by said first drive, whereby passage through said opening is substantially restricted; and a controller, said first drive coupled and decoupled states being selected by said controller; and wherein said elongate member is moved from its drawn-in state to its said released state in response to said first drive decoupled state being selected, and said elongate member is moved from its said released state to its said drawn-in state under the condition of said first drive coupled state being selected.

65. A gate for controlling passage through an opening including:

a first support means located on one side of the opening;

a second support means located on an opposite side of the opening;

at least one elongate member, having a first and a second end, extendable across the opening between said first and second support means;

a first drive means to draw in said elongate member to thereby restrict passage through said opening; and a control means for coupling and decoupling said first drive means;

wherein decoupling of said first drive means allows for release of said at least one elongate member to thereby enable passage through said opening and coupling of said first drive means allows for drawing in said at least one elongate member to thereby restrict passage through said opening, wherein said second support means further includes a resilient means to draw said at least one elongate member towards said second support means during release of said at least one elongate member.

66. A gate for controlling passage through an opening including:

a first support means located on one side of the opening;

a second support means located on an opposite side of the opening;

at least one elongate member, having a first and a second end, extendable across the opening between said first and second support means, wherein said first end is joined to a termination means adapted to engage a locking means located in said first support means; and a control means for releasing said at least one elongate member to thereby enable passage through said opening, and drawing said elongate member towards a first aperture in said first support means; wherein said elongate member remains substantially external to said first support means and little to none of said elongate member enters said first support means when said gate is in a locked or closed position to thereby restrict passage through said opening, wherein said second support means further includes a resilient means to draw said at least one elongate member towards said second support means during release of said at least one elongate member.

* * * * *